US007510305B2

(12) United States Patent
Straton et al.

(10) Patent No.: US 7,510,305 B2
(45) **Date of Patent: *Mar. 31, 2009**

(54) AIR-HANDLING LIGHT FIXTURE AND LENS ASSEMBLY FOR SAME

(75) Inventors: Kenneth G. Straton, Conyers, GA (US); John T. Mayfield, III, Loganville, GA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/772,633

(22) Filed: Jul. 2, 2007

(65) Prior Publication Data

US 2008/0019126 A1 Jan. 24, 2008

Related U.S. Application Data

(60) Continuation-in-part of application No. 11/735,890, filed on Apr. 16, 2007, now Pat. No. 7,296,910, which is a division of application No. 10/970,615, filed on Oct. 21, 2004, now Pat. No. 7,229,192.

(60) Provisional application No. 60/580,996, filed on Jun. 18, 2004.

(51) Int. Cl.
*F21V 29/00* (2006.01)

(52) U.S. Cl. ..... 362/294; 362/223; 362/328; 362/340

(58) Field of Classification Search ..... 362/294, 362/373, 224, 225, 260, 328, 330, 335, 338, 362/347, 29, 327, 340, 217, 223
See application file for complete search history.

(56) References Cited

U.S. PATENT DOCUMENTS

| | | | | | |
|---|---|---|---|---|---|
| 1,380,135 | A * | 5/1921 | Corbin, Jr. | ..... | 126/248 |
| 3,112,891 | A * | 12/1963 | Cutler | ..... | 362/216 |
| 3,297,075 | A * | 1/1967 | Howell et al. | ..... | 160/19 |
| 3,710,094 | A * | 1/1973 | Monte et al. | ..... | 362/218 |
| 3,838,268 | A * | 9/1974 | Fabbri | ..... | 362/218 |
| 3,846,072 | A * | 11/1974 | Patterson | ..... | 96/222 |
| 5,025,356 | A * | 6/1991 | Gawad | ..... | 362/221 |
| 5,171,084 | A * | 12/1992 | Burkarth | ..... | 362/480 |
| 5,479,327 | A * | 12/1995 | Chen | ..... | 362/222 |
| 5,513,296 | A * | 4/1996 | Goldstein | ..... | 392/365 |
| 5,537,304 | A * | 7/1996 | Klaus | ..... | 362/373 |
| 5,918,972 | A * | 7/1999 | Van Belle | ..... | 362/480 |
| 6,286,980 | B1 * | 9/2001 | Meyer | ..... | 362/365 |
| 7,229,192 | B2 * | 6/2007 | Mayfield et al. | ..... | 362/223 |

* cited by examiner

*Primary Examiner*—Sandra L. O'Shea
*Assistant Examiner*—Gunyoung T. Lee
(74) *Attorney, Agent, or Firm*—Ballard Spahr Andrews & Ingersoll, LLP

(57) ABSTRACT

A light fixture or troffer for directing light emitted from a light source toward an area to be illuminated, including a reflector assembly within which the light source is positioned and a lens assembly detachably secured to a portion of the reflector assembly such that a lens of the lens assembly overlies the light source and such that substantially all of the light emitted from the light source passes through the lens assembly. In one aspect, the reflector assembly defines a plurality of air slots.

51 Claims, 23 Drawing Sheets

Input Watts 85 Luminous Dimensions Length: 3.7' x Width 1.7' x Height 0.0'

Quadralaterally Symmetric
Dashed=0 Solid=90

CANDLEPOWER SUMMARY

| Angle | 0 | 22.5 | 45 | 67.5 | 90 | Lumens |
|---|---|---|---|---|---|---|
| 0 | 2612 | 2612 | 2612 | 2612 | 2612 | |
| 5 | 2666 | 2650 | 2607 | 2572 | 2558 | 249 |
| 10 | 2615 | 2622 | 2599 | 2582 | 2555 | |
| 15 | 2550 | 2568 | 2574 | 2583 | 2574 | 729 |
| 20 | 2467 | 2495 | 2534 | 2572 | 2578 | |
| 25 | 2364 | 2413 | 2484 | 2580 | 2629 | 1154 |
| 30 | 2239 | 2310 | 2444 | 2720 | 2835 | |
| 35 | 2099 | 2191 | 2467 | 2467 | 2978 | 1579 |
| 40 | 1928 | 2050 | 2491 | 2858 | 2521 | |
| 45 | 1745 | 1906 | 2343 | 2674 | 1457 | 1469 |
| 50 | 1526 | 1741 | 1707 | 1736 | 908 | |
| 55 | 1284 | 1499 | 958 | 953 | 823 | 952 |
| 60 | 1003 | 1100 | 604 | 780 | 581 | |
| 65 | 619 | 561 | 342 | 574 | 180 | 378 |
| 70 | 126 | 130 | 107 | 220 | 34 | |
| 75 | 40 | 32 | 25 | 43 | 17 | 28 |
| 80 | 18 | 15 | 13 | 19 | 8 | |
| 85 | 6 | 6 | 5 | 2 | 1 | 5 |
| 90 | 0 | 0 | 0 | 0 | 0 | |

ZONAL LUMEN SUMMARY

| Zone | Lumens | % Lamp | % Luminaire |
|---|---|---|---|
| 0 - 30 | 2132 | 24.6 | 32.5 |
| 0 - 40 | 3711 | 42.7 | 56.6 |
| 0 - 60 | 6142 | 70.6 | 93.7 |
| 60 - 90 | 409 | 4.6 | 6.3 |
| 0 - 90 | 6552 | 75.3 | 100.0 |
| 90 -180 | 0 | 0.0 | 0.0 |
| 0 -180 | 6552 | 75.3 | 100.0 |

Luminaire Efficiency: 75.3%

CIE Classification: Direct

Spacing Criterion ( 0% ): 1.3
Spacing Criterion (90%): 1.6

AVERAGE LUMINANCE
(Candelas/ Sq. Meter)

| Angle | 0 | 45 | 90 |
|---|---|---|---|
| 0 | 4320 | 4320 | 4320 |
| 45 | 4082 | 5481 | 3408 |
| 55 | 3703 | 2763 | 2373 |
| 65 | 2423 | 1333 | 704 |
| 75 | 256 | 160 | 109 |
| 85 | 114 | 95 | 19 |

CANDELA DISTRIBUTION

| Angle | 0 | 22.5 | 45 | 67.5 | 90 | 90 | Lumens |
|---|---|---|---|---|---|---|---|
| 0 | 1690 | 1690 | 1690 | 1690 | 1690 | 1690 | |
| 5 | 1710 | 1695 | 1681 | 1673 | 1670 | 1685 | 160 |
| 10 | 1690 | 1678 | 1668 | 1669 | 1665 | 1673 | |
| 15 | 1654 | 1644 | 1642 | 1647 | 1643 | 1645 | 464 |
| 20 | 1598 | 1591 | 1598 | 1610 | 1609 | 1601 | |
| 25 | 1528 | 1524 | 1541 | 1559 | 1561 | 1542 | 710 |
| 30 | 1434 | 1436 | 1461 | 1488 | 1493 | 1462 | |
| 35 | 1324 | 1333 | 1372 | 1406 | 1416 | 1370 | 855 |
| 40 | 1197 | 1211 | 1263 | 1308 | 1234 | 1261 | |
| 45 | 1060 | 1078 | 1148 | 1208 | 1136 | 1148 | 884 |
| 50 | 905 | 936 | 1031 | 1108 | 1036 | 1024 | |
| 55 | 743 | 794 | 911 | 1004 | 924 | 900 | 805 |
| 60 | 580 | 658 | 792 | 894 | 714 | 774 | |
| 65 | 436 | 524 | 674 | 731 | 486 | 626 | 616 |
| 70 | 310 | 400 | 526 | 506 | 456 | 456 | |
| 75 | 203 | 262 | 323 | 288 | 264 | 282 | 299 |
| 80 | 106 | 155 | 149 | 107 | 90 | 127 | |
| 85 | 34 | 40 | 23 | 21 | 20 | 28 | 44 |
| 90 | 0 | 0 | 0 | 0 | 0 | 0 | |

ZONAL LUMEN SUMMARY

| Zone | Lumens | % Lamp | % Fixture |
|---|---|---|---|
| 0 - 30 | 1334.4 | 24.3 | 27.6 |
| 0 - 40 | 2189.7 | 40.0 | 45.3 |
| 0 - 60 | 3878.6 | 70.8 | 80.2 |
| 0 - 90 | 4836.0 | 88.3 | 100.0 |
| 90 -180 | 0.0 | 0.0 | 0.0 |
| 0 -180 | 48.38 | 88.3 | 100.0 |

LUMINAIRE EFFICIENCY: 88.3%

CIE CLASSIFICATION: Direct

SPACING CRITERIA ( 0-Deg ): 1.3
SPACING CRITERIA (90-Deg): 1.3

AVERAGE LUMINANCE (cd/m2)

| Angle | 0 | 45 | 90 |
|---|---|---|---|
| 45 | 2127 | 2304 | 2476 |
| 55 | 1838 | 2254 | 2563 |
| 65 | 1464 | 2263 | 2397 |
| 75 | 1113 | 1771 | 1447 |
| 85 | 554 | 374 | 326 |

Calculations based on IES File Luminous Area:
23.28 in. W x 46.92 in. L x 0.0 in. H

AIR-HANDLING LIGHT FIXTURE AND LENS ASSEMBLY FOR SAME

This application is a continuation-in-part application of U.S. patent application Ser. No. 11/735,890, filed Apr. 16, 2007, now U.S. Pat. No. 7,296,910 which is a divisional application of U.S. patent application Ser. No. 10/970,615, filed Oct. 21, 2004, now U.S. Pat. No. 7,229,192 which claims priority to and the benefit of U.S. Provisional Application No. 60/580,996, filed on Jun. 18, 2004, which is incorporated in its entirety in this document by reference.

BACKGROUND OF THE INVENTION

1. Field of the Invention

The present invention generally relates to light fixtures for illuminating architectural spaces. The invention has particular application in light fixtures that are in fluid communication with an air supply source or air exhaust system.

2. Background Art

Numerous light fixtures for architectural lighting applications are known. In the case of fixtures that provide direct lighting, the source of illumination may be visible in its entirety through an output aperture of the light fixture or shielded by elements such as parabolic baffles or lenses. A light fixture presently used in a typical office environment comprises a troffer with at least one fluorescent lamp and a lens having prismatic elements for distributing the light. Also known are light fixtures that use parabolic reflectors to provide a desired light distribution. The choice of light fixture will depend on the objectives of the lighting designer for a particular application and the economic resources available. To meet his or her design objectives, the lighting designer, when choosing a light fixture, will normally consider a variety of factors including aesthetic appearance, desired light distribution characteristics, efficiency, lumen package, maintenance and sources of brightness that can detract from visual comfort and productivity.

An important factor in the design of light fixtures for a particular application is the light source. The fluorescent lamp has long been the light source of choice among lighting designers in many commercial applications, particularly for indoor office lighting. For many years the most common fluorescent lamps for use in indoor lighting have been the linear T8 (1 inch diameter) and the T12 (1½ inch diameter). More recently, however, smaller diameter fluorescent lamps have become available, which provide a high lumen output from a comparatively small lamp envelope. An example is the linear T5 (⅝ inch diameter) lamp manufactured by Osram/Sylvania and others. The T5 has a number of advantages over the T8 and T12, including the design of light fixtures that provide a high lumen output with fewer lamps, which reduces lamp disposal requirements and has the potential for reducing overall costs. The smaller-diameter T5 lamps also permit the design of smaller light fixtures.

Some conventional fluorescent lamps, however, have the significant drawback in that the lamp surface is bright when compared to a lamp of larger diameter. For example, a conventional T5 lamp can have a surface brightness in the range of 5,000 to 8,000 footlamberts (FL), whereas the surface brightness of the larger T8 and T12 lamps generally is about 3,000 FL and 2,000 FL, respectively (although there are some versions of linear T8 and T12 lamps with higher brightness). The consequence of such bright surfaces is quite severe in applications where the lamps may be viewed directly. Without adequate shielding, fixtures employing such lamps are very uncomfortable and produce direct and reflected glare that impairs the comfort of the lighting environment. Heretofore, opaque shielding has been devised to cover or substantially surround a fluorescent lamp to mitigate problems associated with light sources of high surface brightness; however, such shielding defeats the advantages of a fluorescent lamp in regions of distribution where the lamp's surfaces are not directly viewed or do not set up reflected glare patterns. Thus, with conventional shielding designs, the distribution efficiencies and high lumen output advantages of the fluorescent lamp can be substantially lost.

A further disadvantage to traditional parabolic and prismatic troffers is the presence of distracting dynamic changes in brightness level and pattern as seen by a moving observer in the architectural space. Additionally, traditional parabolic and prismatic troffers allow direct or only slightly obscured views of the lamp source(s)) at certain viewing angles (low angles for both the parabolic and prismatic and most transverse angle for prismatic). This unaesthetic condition is remedied by indirect and direct-indirect fixture designs, but typically with a significant loss of efficiency.

Another known solution to the problem of direct glare associated with the use of high brightness fluorescent lamps is the use of biax lamps in direct-indirect light fixtures. This approach uses high brightness lamps only for the uplight component of the light fixture while using T-8 lamps with less bright surfaces for the light fixture's down-light component. However, such design approaches have the drawback that the extra lamps impair the designer's ability to achieve a desired light distribution from a given physical envelope and impose added burdens on lamp maintenance providers who must stock and handle two different types of lamps.

Conventional parabolic light fixture designs have several negative features. One of these is reduced lighting efficiency. Another is the so-called "cave effect," where the upper portions of walls in the illuminated area are dark. In addition, the light distribution of these fixtures often creates a defined line on the walls between the higher lit and less lit areas. This creates the perception of a ceiling that is lower than it actually is. Further, when viewed directly at high viewing angles, a conventional parabolic fixture can appear very dim or, even, off.

Most modern heating and/or air conditioning systems used in the world today are non-self contained systems and employ forced air circulation, that is, air is drawn from a room to be heated or cooled, passed through a heating and/or air conditioning system in which the air is heated or cooled and then distributed back through a duct work system to the room to thereby raise or lower the air temperature in the room according to comfort requirements. In some instances air is merely circulated in such system without heating or cooling to improve ventilation. While the air distribution system can be arranged to discharge forced air through the floor, or through a wall of a room, the most common practice is to discharge air, whether for heating, cooling or for ventilation, through the ceiling because most building construction permits ready access to a ceiling compared to a floor or wall.

To distribute air from a forced air system through a ceiling, the common practice is to utilize a ceiling vent which typically is designed to not only provide an opening through which air can pass through a ceiling into a room but also to aid in distribution of air in the room. Another desired aspect of a ceiling vent is to provide an improved appearance, that is, to provide a way for air to enter a room that is other than simply a hole in the ceiling with which a forced air duct communicates.

The present invention overcomes the above-described disadvantages of light fixtures using brighter light sources by providing a configuration that appears to a viewer as though it has a source of lower brightness, but which otherwise permits the light fixture to advantageously and efficiently distribute light generated by the selected lamp, such as the exemplified T5 lamp. The light fixture of the present invention reduces distracting direct glare associated with high brightness light sources used in direct or direct-indirect light fixtures. This reduction in glare is accomplished without the addition of lamps and the added costs associated therewith. Additionally, the present invention provides a combination light fixture and air diffuser that enhances the visual appearance of the room by decreasing the number of separate components attached to or extending from the ceiling.

SUMMARY OF THE INVENTION

The present invention relates to a light fixture, or troffer, for efficiently distributing light emitted by a light source into an area to be illuminated and distributing into or withdrawing air from the area to be illuminated. In one general aspect of the invention, the light fixture includes a reflector assembly that supports the light source. The light fixture may also include a lens assembly positioned with respect to a portion of the reflector assembly to receive light emitted by the light source and distribute it such that glare is further reduced. In a preferred embodiment, the lens assembly receives and distributes substantially all of the light emitted by the light source.

In one aspect, the reflector assembly of the light fixture includes a base member that extends longitudinally between spaced edges along a longitudinal axis. At least a portion of the base member can form a reflective surface, which is preferably a curved reflective surface. In one aspect, the reflector assembly supports the light source such that the longitudinal axis of the light source is substantially parallel to that of the base member. The light source is preferably supported in a recessed portion of the reflector assembly whereby high angle glare in directions transverse to the longitudinal axis of the light fixture is blocked by the lower side edges of the light fixture. The light source can be a conventional lamp, such as, for example, a T5 lamp. In a further aspect, a portion of the base member defines a plurality of air slots that are in operative communication with a remote HVAC system.

In another aspect, the lens assembly includes a lens that has a first end edge, an opposed second end edge, and a central lens portion that extends longitudinally between the first and second end edges. In one aspect, the lens has a lens longitudinal axis that is generally parallel to the light source longitudinal axis. The central portion of the lens has a prismatic surface that defines a face that can be oriented toward or away from the light source. In one aspect, the central lens portion is curved and can have a concave, convex, or planar shape in cross-section. In an alternative aspect, the lens assembly may include a diffuser inlay that is positioned in substantially overlying registration with a portion of the face of the central lens portion that faces the light source.

In one embodiment, the prismatic surface of the central lens portion is concave relative to the light source. At least a portion of the prismatic surface defines an array of contiguous and parallel prismatic elements. In one example, each prismatic element extends generally longitudinally and substantially between the first and second edges of the lens. In one example, the prismatic elements each have a curved surface that subtends an angle, in a transverse vertical plane, of about and between 80° to 120° with respect to their center of curvature.

The lens is preferably detachably secured to a portion of the reflector assembly in overlying registration with the light source. In one aspect, a portion of the reflector assembly and a portion of the lens substantially enclose the light source so that, to an external viewer, the light source is substantially hidden from view. In one example, the array of linear extending prismatic elements presents to the external viewer an array of spaced, longitudinally extending shadows, or dark stripes, on the lens. Thus, the lens assembly of the present invention provides an aesthetically more pleasing appearance as well as efficiently distributing the light generated by the light source onto portions of the reflective surfaces of the reflector assembly and onto the desired area to be illuminated.

The lens assembly and reflector assembly of the present invention increase the light efficiency of the light fixture and diffuse the light relatively uniformly, which minimizes the "cave effect" commonly noted in areas using conventional parabolic light fixtures in the ceiling. In one embodiment, the light fixture or troffer of the present invention results in a luminare efficiency that is greater than 80%, preferably.

BRIEF DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
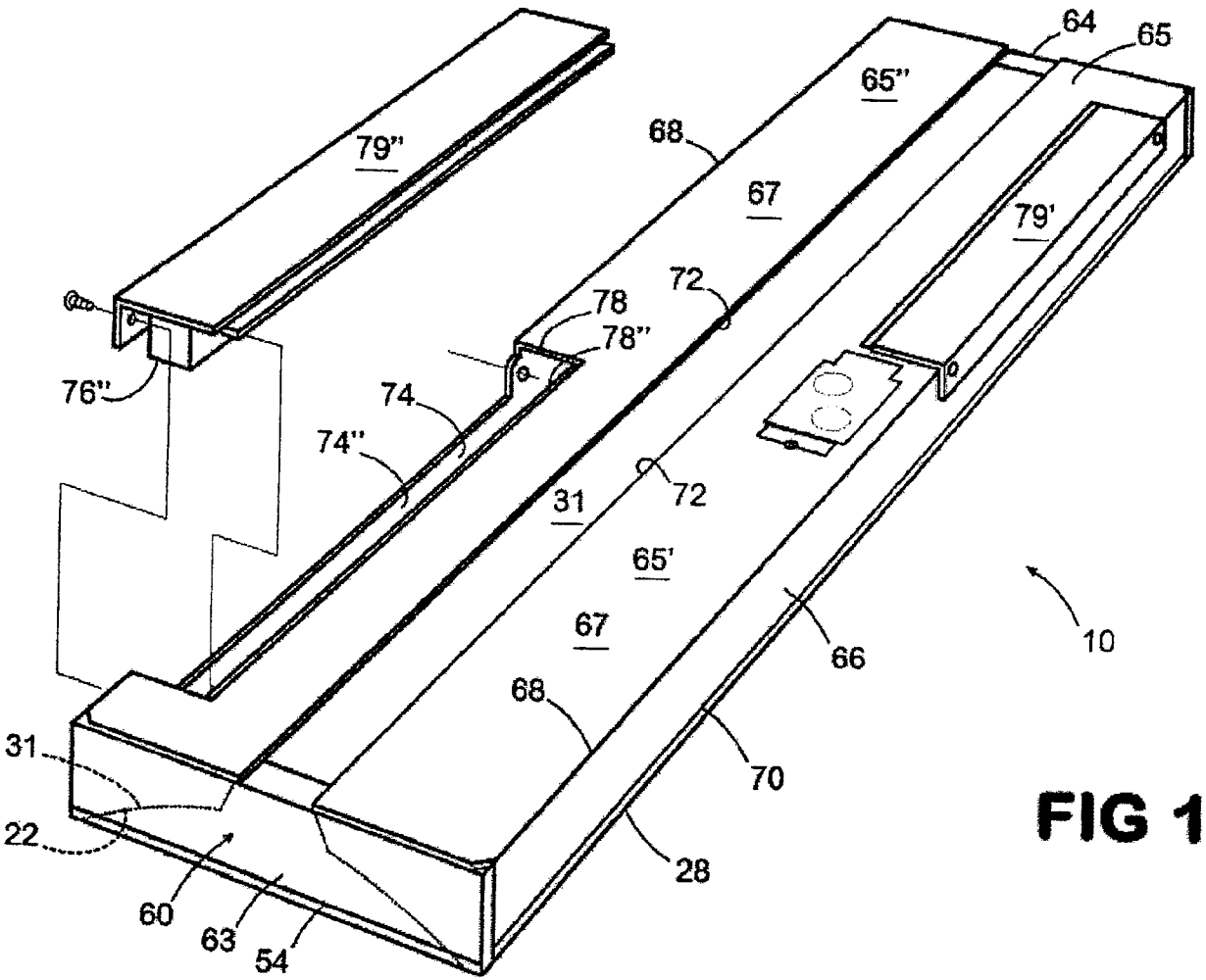
FIG. 1 is an exploded top perspective view of one embodiment of the light fixture of the present invention.

The present invention is more particularly described in the following exemplary embodiments that are intended as illustrative only since numerous modifications and variations therein will be apparent to those skilled in the art. As used herein, "a," "an," or "the" can mean one or more, depending upon the context in which it is used. The preferred embodiments are now described with reference to the figures, in which like reference characters indicate like parts throughout the several views.

Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment.

Referring to FIGS. 1-6, a light fixture 10 or troffer of the present invention for illuminating an area includes a reflector assembly 20 for housing a linear light source 12. The light source extends along a light longitudinal axis between a first end 14 of the light source and a spaced second end 16 thereof. Light emanating from the light source 12 is diffused by a lens assembly 100 that is positioned between the light source 12 and the area to be illuminated. The light source 12 may be a conventional fluorescent lamp, and in one aspect, the light source 12 can be a conventional T5 lamp.

The reflector assembly 20 of the light fixture includes an elongated base member 22 that has a first end edge 24, a spaced second end edge 26, a first longitudinally extending side edge 28 and an opposed second longitudinally extending side edge 29. The base member 22 further has a base surface 30 extending along a base longitudinal axis. The base member can be formed from a single piece of material or from a plurality of adjoined pieces. As one will appreciate, the reflector assembly can be formed from any code-compliant material. For example, the base member can be formed from steel.

A portion of the base surface 30 of the base member 22 forms at least one longitudinally extending hollow 32 that extends inwardly in the transverse dimension with respect to and away from the respective first and second longitudinally extending side edges. Each hollow 32 has a first hollow edge 34 and a second hollow edge 36 and extends inwardly toward a central portion 38 defined by and between the respective first and second hollow edges 34, 36. The central portion defines a longitudinally extending trough 40 that extends inwardly away from the surface of the hollow 32. At least a portion of each hollow 32 preferably forms a reflective surface 33 extending between central portion 38 and a respective one of the first and second hollow edges 34, 36. In one embodiment, at least a portion of a section of each hollow 32 normal to the base longitudinal axis has a generally curved shape such that such that portions of the hollow 32 form a generally curved reflective surface 35 for diffusely reflecting light received from the lens into the architectural space in a desired pattern. In one embodiment, the transverse section of the hollow can have a conventional barrel shape. In an alternative embodiment, a portion of each hollow 32 can have at least one planar portion.

In one aspect, at least a portion of the hollow of the base surface 30 of the base member can be painted or coated with a reflective material or formed from a reflective material. The reflective material may be substantially glossy or substantially flat. In one example, the reflective material is preferably matte white to diffusely reflect incident light.

Figure 6:
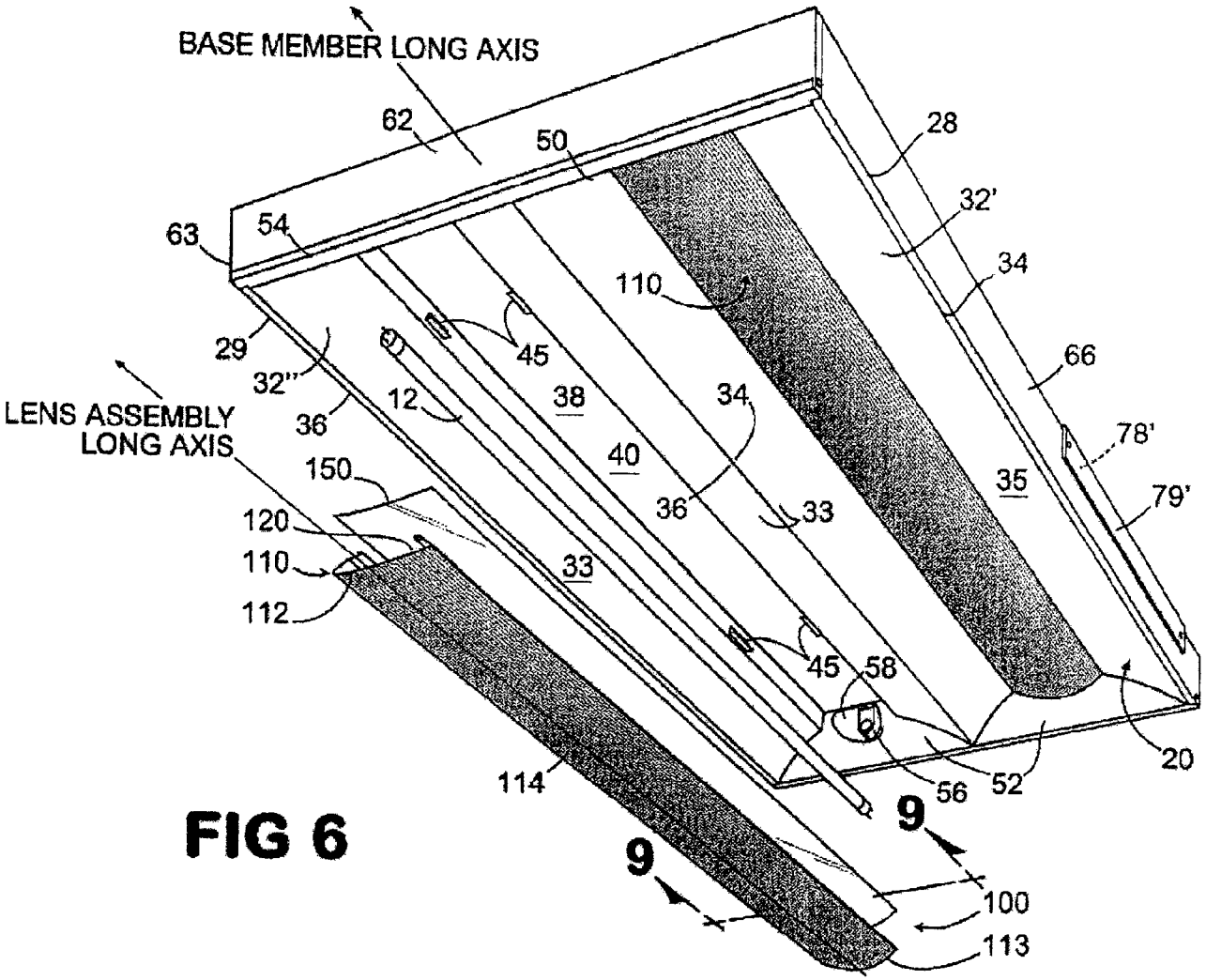
FIG. 6 is an exploded bottom perspective view of a second embodiment of the light fixture of the present invention.

The central portion 38 of the light fixture is preferably symmetrically positioned with respect to the first and second hollow edges 34, 36. The light fixture 10 of the present invention can include one or more hollows 32 that each houses a light source 12, as shown in FIG. 6. For example, in a light fixture having a single hollow, the first and second hollow edges 34, 36 of the hollow would extend generally to the respective longitudinally extending side edges 28, 29 of the base member 22. In an alternative example, in which the light fixture 10 has two hollows, the base member 22 defines a pair of adjoining, parallel hollows. Here, a first hollow edge 34 of a first hollow 32' extends generally to the first side edge 28 of the base member, and a second hollow edge 36 of a second hollow 32" of the pair of hollows extends generally to the second side edge 29 of the base member. The second hollow edge 36 of the first hollow 32' and the first hollow edge 34 of the second hollow 32" are adjoined in one example. Alternatively, the second hollow edge 36 of the first hollow 32' and the first hollow edge 34 of the second hollow 32" are positioned proximate or near each other.

Figure 5A:
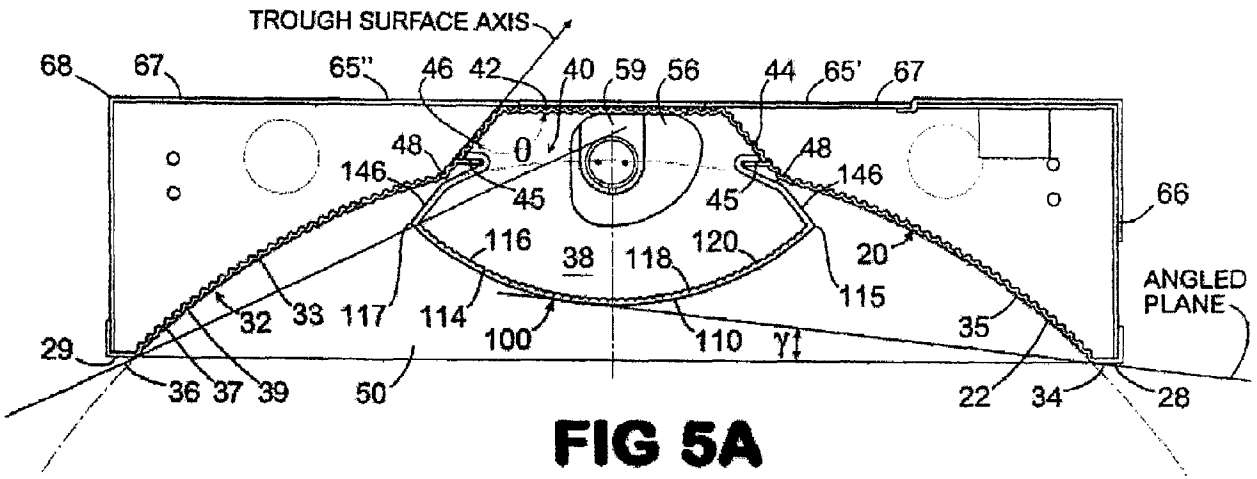
FIG. 5A is a cross-sectional view of the light fixture of FIG. 3, taken along line 5-5.
Figure 5B:
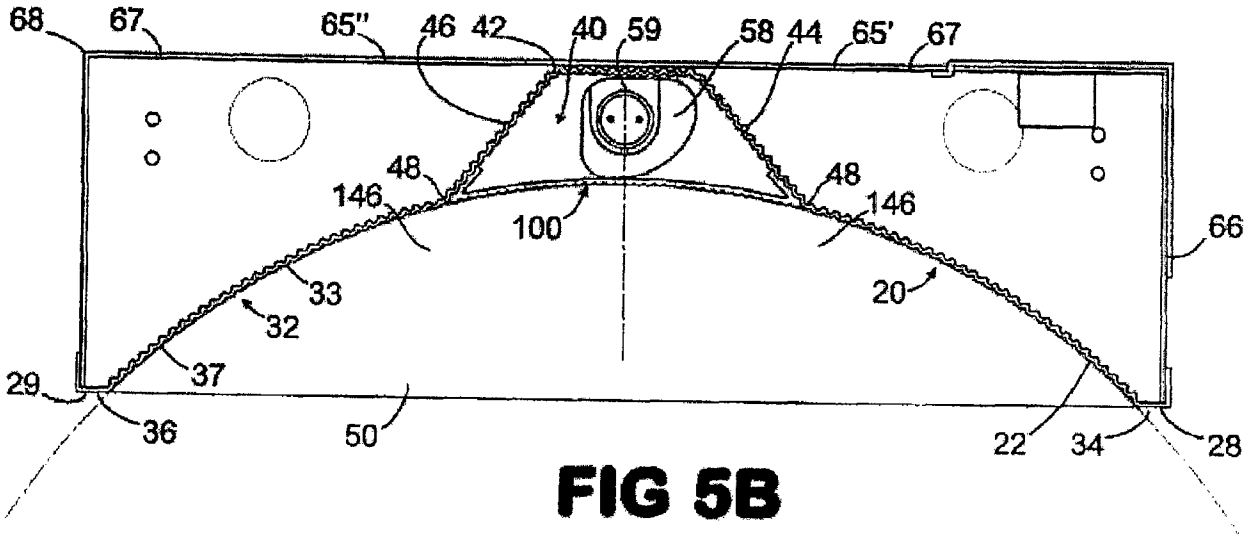
FIG. 5B is a cross-sectional view of one embodiment of the light fixture, showing the central lens portion having a concave shape.
Figure 5C:
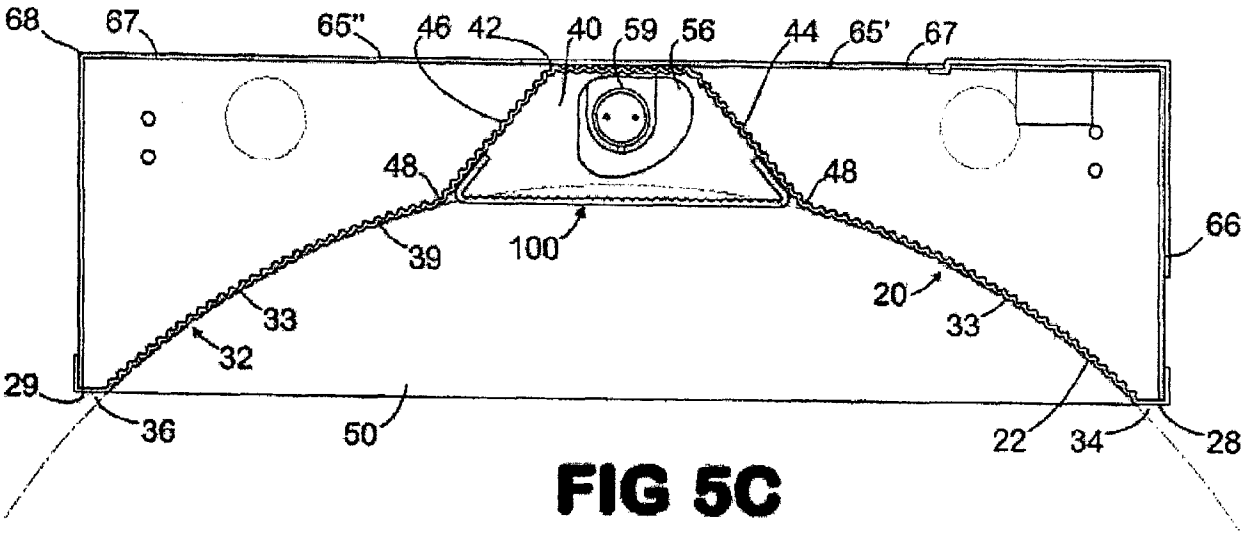
FIG. 5C is a cross-sectional view of one embodiment of the light fixture, showing at least a portion of the central lens portion having a flat shape.

In one aspect, at least a portion of the base surface 30 of the base member 22, preferably at least a portion of the reflective surface 33 thereof, has a plurality of male ridges 37, see FIGS. 5B-5C, formed thereon that extend longitudinally between the ends of the base member. In an alternative aspect, at least a portion of the base surface 30 of the base member, preferably at least a portion of the reflective surface 33 thereof, has a plurality of female grooves 39 formed thereon that extend longitudinally between the ends of the base member. Alternatively, the ridges or grooves extend at an angle with respect to the longitudinal axis of the base member. For example, the male ridges or female grooves may extend transversely with respect to the base longitudinal axis (i.e., extending between the respective first and second longitudinally extending side edges 28, 29 of the base member). In another aspect, each male ridge or female groove 37, 39 can extend substantially parallel to an adjoining male ridge or female groove. The ridges 37 or grooves 39 formed on the hollow 32 provide a diffusely reflecting surface.

The trough 40 is formed by a top surface 42, a first side trough surface 44 and an opposed second side trough surface 46 is provided for receiving the elongated light source 12. The trough extends along an axis parallel to the longitudinal axis of the light fixture. Each respective first and second side trough surface has a lower edge 48 that is integral with a portion of the adjoined hollow 32. In one example, the lower edges of the first and the second trough surfaces are integral with the reflective surfaces 33 of the adjoined hollow. Each respective first and second side trough surface defines a trough surface axis (FIG. 5A) that extends in a vertical plane normal to the base longitudinal axis of the base member.

In one aspect, the trough surface axis of each of the first and second trough surfaces 44, 46 respectively forms an angle θ of about and between about 140° to 90° with respect to the top surface 42 of the trough. More particularly, the angle θ can be about and between about 135° to 95° with respect to the top surface of the trough. Still more particularly, the angle θ can be about and between about 130° to 100° with respect to the top surface of the trough. In another aspect, the angle θ formed between each of the respective first and second trough surfaces and the top surface of the trough can be substantially equal.

In one aspect of the invention, the light source 12 can be positioned between the base surface of the base member and the lens assembly. In another aspect of the invention, the light source 12 can be positioned within the trough 40 of the reflector assembly 20 such that the light longitudinal axis is positioned above a plane that extends between the lower edges 48 of the respective first and second trough surfaces. Alternatively, the light source 12 can be positioned within the trough of the reflector assembly such that the light source is positioned substantially about or above an arcuate section that extends between the lower edges 48 of the respective first and second trough surfaces 44, 46 and is an arcuate continuation of the curvature of the curved reflective surfaces 35 of the hollow. In this aspect, the radius of the arcuate section can have substantially the same radius as the curved portion of the hollow. If the curved reflective surfaces of the hollow are parabolic, the arcuate section is a parabolic extension of the parabolas of the curved reflective surface.

The reflector assembly 20 can also include a first end face 50 and an opposed second end face 52. Each of the end faces extends upwardly away from a respective bottom edge 54 toward a top edge 55 of the light fixture. Each end face has a face longitudinal axis that forms an obtuse angle with respect to the longitudinal axis of the base member 22. In one aspect, the end faces 50, 52 are positioned with respect to the base member such that a portion of the top edge 55 of the end faces 50, 52 is positioned in substantial overlying registration with portions of the base surface 30. It is contemplated that at least a portion of the top edge 55 can contact at least a portion of the base surface 30. In another aspect, at least a portion of the top edge 55 is spaced inwardly from the end edges 24, 26 of the base member. The angled first and second end faces 50, 52 optically alter the apparent perspective of the light fixture and aesthetically give the light fixture a deeper appearance.

In one aspect, the face longitudinal axis of each of the first and second end faces 50, 52 respectively forms an angle Ω of about and between 95° to 160° with respect to the base longitudinal axis of the base member 22. More particularly, the face longitudinal axis of each of the first and second end faces respectively forms an angle Ω of about and between 100° to 150° with respect to the base longitudinal axis. Still more particularly, the face longitudinal axis of each of the first and second end faces respectively forms an angle Ω of about and between 100° to 135° with respect to the base longitudinal axis. In another aspect, the face longitudinal axis of each of the first and second end faces respectively forms an angle Ω of about 120° with respect to the base longitudinal axis. In yet another aspect, the respective obtuse angles formed between the face longitudinal axis of the first end face 50 and between the face longitudinal axis of the second end face 52 and the base longitudinal axis of the base member 22 are substantially equal.

Alternative shapes of the first and second end faces 50, 52 are contemplated. Each of the first and second end faces may be substantially planar or non-planar. In the non-planar embodiments, portions of the first and second end faces are curved. The curved portions of the first and second end faces can be substantially concave or substantially convex. Portions of the first and second end faces can also have male ridges or female grooves formed thereon. The male ridges or female grooves can be sized, shaped and oriented to visually complement the male ridges or female grooves on the base member 22, as described above.

Figure 2:
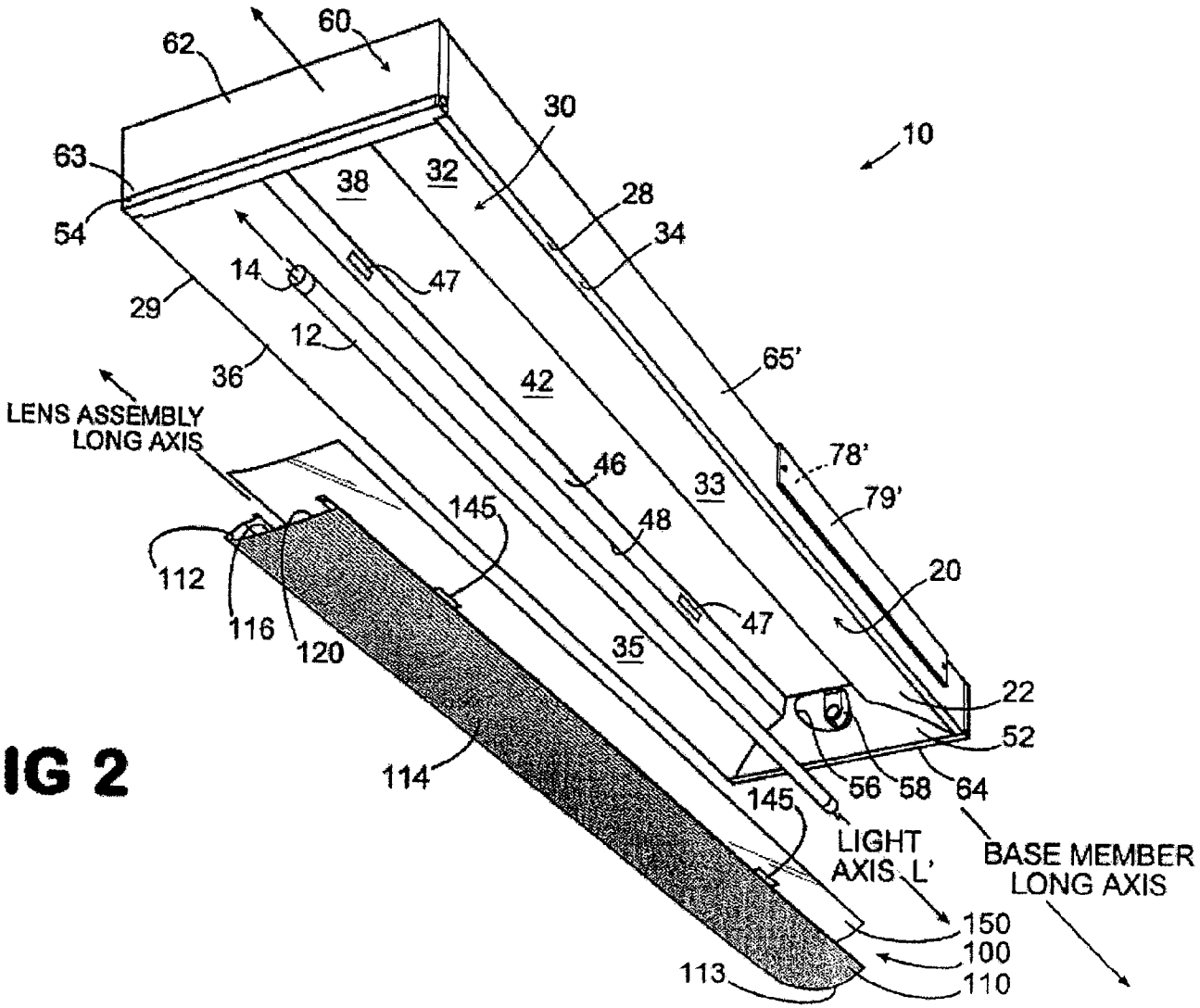
FIG. 2 is an exploded bottom perspective view of the light fixture of FIG. 1.
Figure 3:
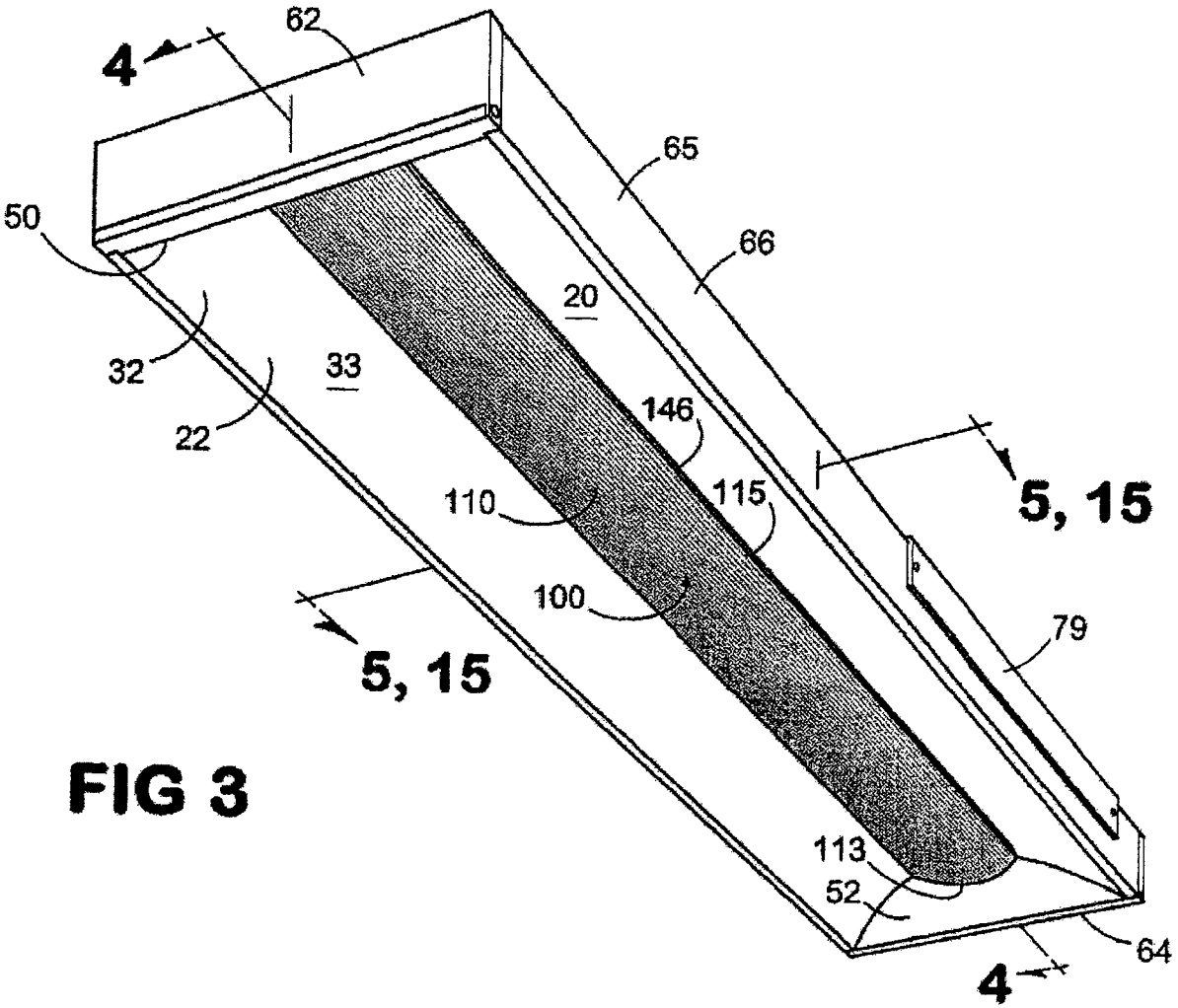
FIG. 3 is a bottom perspective view of the light fixture of FIG. 2.
Figure 4:
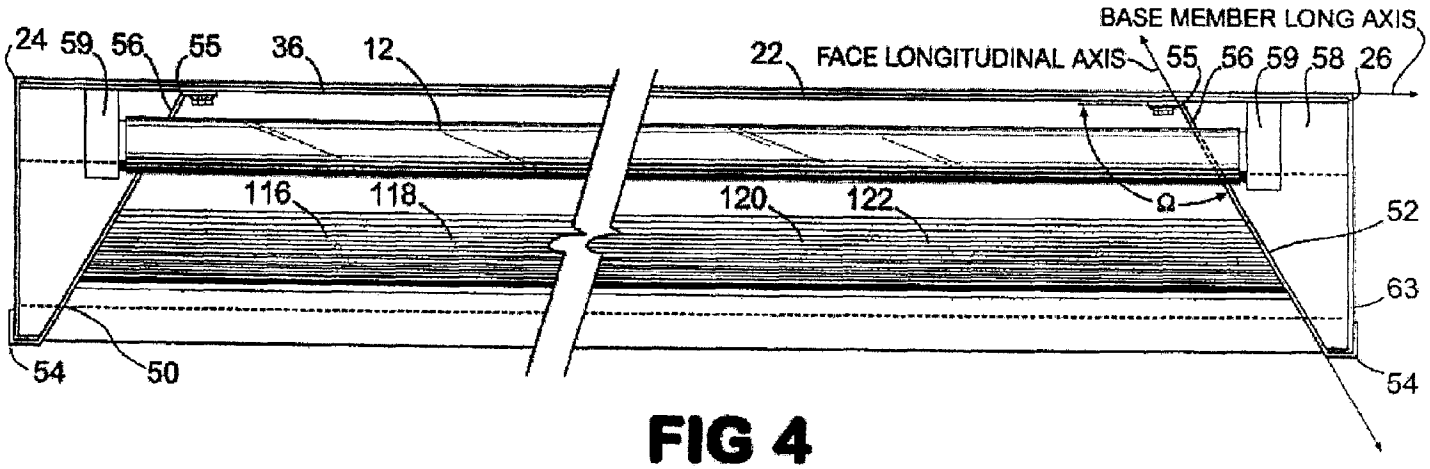
FIG. 4 is a cross-sectional view of the light fixture of FIG. 3, taken along line 4-4.

The light fixture 10 of the present invention also includes a housing 60 having a first end wall 62 and a second end wall 64. In one aspect, as shown in FIG. 2, the first end wall 62 is connected to a portion of the first end edge 24 of the base member 22 and the second end wall is connected to a portion of the second end edge 26 of the base member 22. In this aspect, as shown in FIG. 4, a portion of the a bottom edge 54 of the first end face 50 can be connected to a bottom portion 63 of the first end wall 62 of the housing and a portion of bottom edge 54 of the second end face 52 is also connected to a bottom portion 63 of the second end wall 64 of the housing. In one example, the first end wall 62 and the first end face 50 can be formed integral to each other. Similarly, the second end wall 64 and the second end face 52 can be formed integral to each other. The first end wall 62 can be positioned substantially perpendicular to the base member 22 adjacent the first end edge of the base member. Similarly, the second end wall 64 can be positioned substantially perpendicular to the base member 22 adjacent the second end edge of the base member.

In one aspect, an opening 56 is defined in each of the first and second end faces 50, 52, which opening 56 is constructed and arranged to receive at least a portion of a selected end 14,16 of the light source 12 therein. In this aspect, portions of the respective first and second end faces 50, 52, portions of the respective first and second end walls 62, 64, and portions of the base surface 30 together define a chamber 58 adjacent the respective top edges 55 the first and second end faces. The chamber 58 is in operative communication with the opening 56 in the respective first and second faces 50, 52 and is constructed and arranged to receive at least a portion of a selected end 14, 16 of the light source therein. The brighter conventional lamps, such as the exemplified T5 lamp, are typically shorter and have an elongated dark portion proximate their ends when compared to other conventional elongated fluorescent lamps, such as, for example, conventional T8 and T12 lamps. Thus, in use, the chambers prevent the darkened ends of the selected light source from being visible through the lens assembly.

In one aspect, each chamber 58 is constructed and arranged to mount an electrical contact 59 or receptacle for detachably securing a selected end of the light source thereto. In one example, the electrical contact 59 is mounted onto a portion of the base surface 30 of the base member 22 that partially defines the chamber 58. It is contemplated that the electrical contact 59 can be mounted to any of the surfaces that define the chamber 58.

Figure 7:
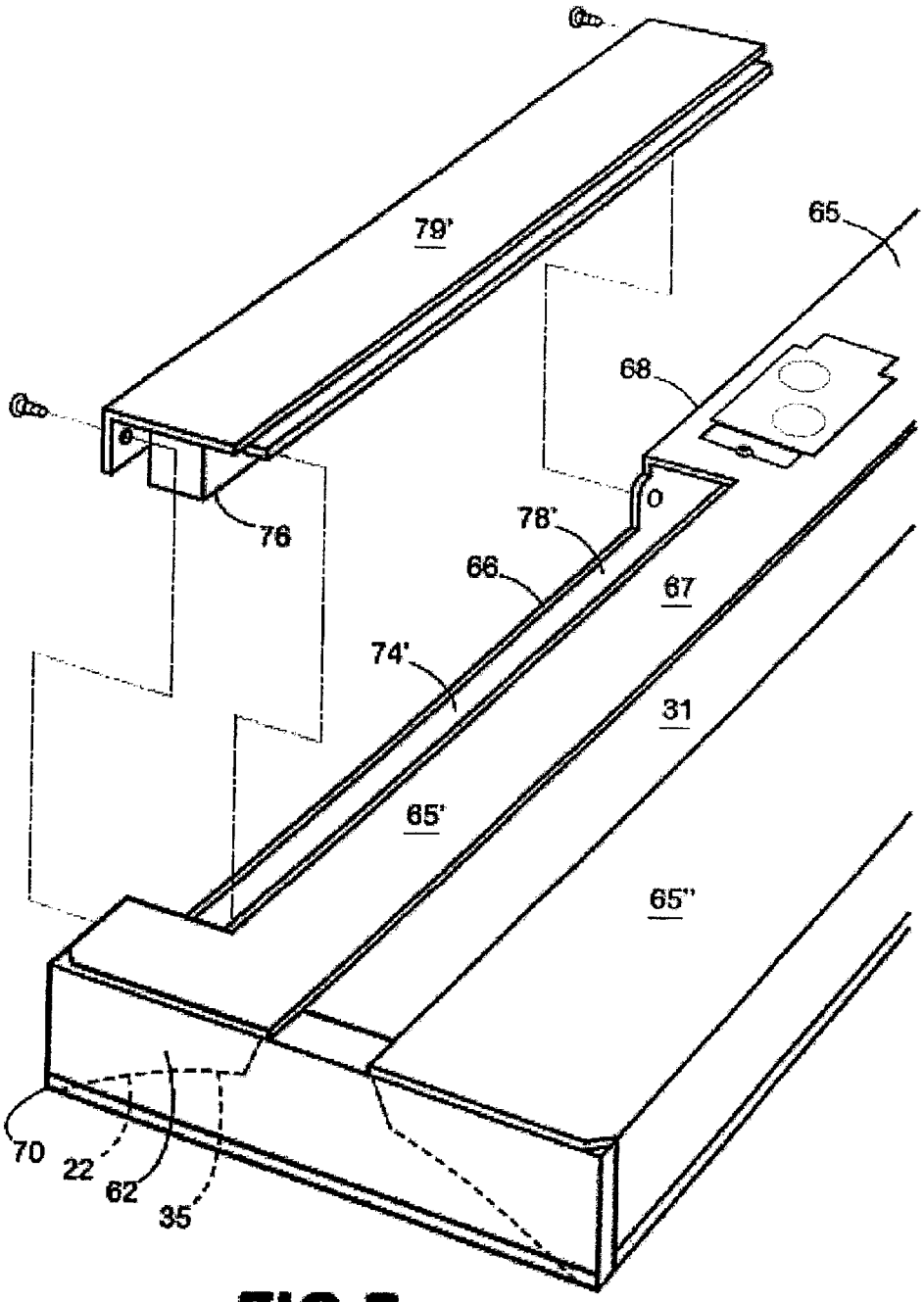
FIG. 7 is a partial top perspective view of a housing of the light fixture showing one embodiment of a closure plate releaseably connected to a port defined within a ballast enclosure.
Figure 8:
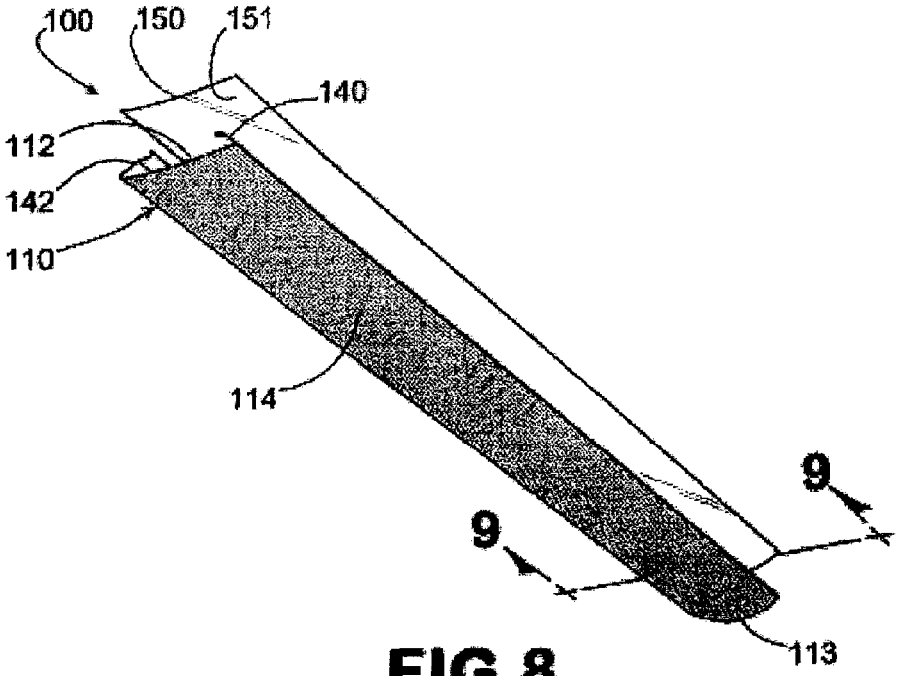
FIG. 8 is an exploded bottom perspective view of one embodiment of a lens assembly of the light fixture of the present invention showing an elongated lens and a diffuser inlay.
Figure 9:
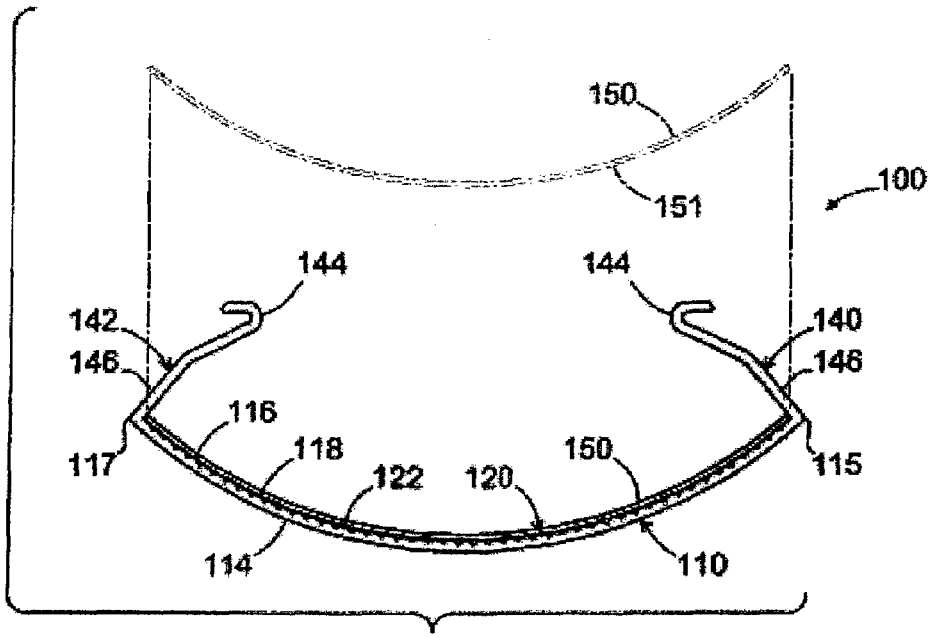
FIG. 9 is a cross-sectional view of the lens assembly of FIG. 8, taken along line 9-9.
Figure 10:
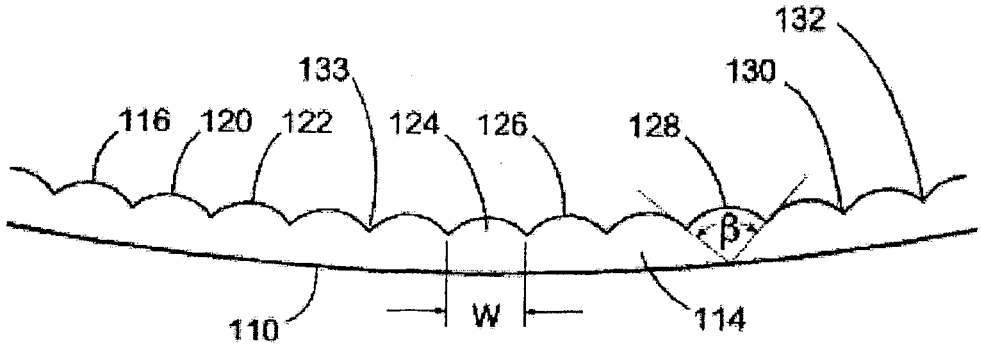
FIG. 10 is an enlarged partial cross-sectional view of the lens assembly of FIG. 8, showing one embodiment of an array of prismatic elements disposed on a surface of the lens.

Referring to FIGS. 1 and 7, the housing of the light fixture can also include at least one angled cover 65, which are exemplarily illustrated as being a pair of angled faces 65' and 65", respectively. In one aspect, each angled cover has a first panel 66 and a second panel 67 that are connected to each other along a common, angled edge 68. Each first panel 66 has a first side edge 70 and each second panel 67 has a second side edge 72. The first side edge 70 of the first panel 66 is connected to a portion of the first longitudinal side edge 28 of the base member 22. The second side edge 72 of the second panel 67 is connected to a portion of the base top surface 31 of the base member 22. In one example, the first panel 66 of the angled cover 65 is substantially perpendicular to the base member 22 adjacent the first longitudinally extending side edge 28 of the base member. In another example, the first and second panels 66, 67 of the angled cover are substantially perpendicular to each other. In one aspect, the angled cover extends between the first and second end walls 62, 64 of the housing 60 such that portions of the first angled cover, portions of the respective first and second end walls 62, 64 and portions of the base top surface 31 together define a first ballast enclosure 74' (FIG. 7).

The light fixture 10 also includes at least one conventional light ballast 76 constructed and arranged for electrically connecting the light source to an external power source. In one aspect, the at least one ballast 76 is positioned within the interior of the first ballast enclosure 74' (FIG. 7). In order to access the ballast, a portion of the first angled cover 65' of the housing 60 of the light fixture defines a first port 78' that is in communication with the interior of the first ballast enclosure 74'. In one aspect, the first port is positioned adjacent the angled edge 68 of the first angled cover 65'. The housing 60 may also include a first closure plate 79' that is constructed and arranged for releasable connection to the first angled cover 65'. In a closed position, the first closure plate is in substantial registration with the first port 78' so that the at least one ballast positioned within the first ballast enclosure 74' can be selectively enclosed.

Referring to FIG. 7, in one aspect, at least a portion of the first port 78' is defined in a portion of the second panel 67 of the first angled cover 65'. In another aspect, at least a portion of the first port 78' is defined in a portion of the first panel 66 of the first angled cover 65'. In this latter example, the defined portion of the first port 78' is spaced from the first side edge 70 of the first panel 66 of the first angled cover a predetermined distance. The predetermined distance is greater than the height of a conventional ceiling panel or tile that would typically abut the bottom portion of the light fixture. Because the predetermined distance is greater than the conventional height of a ceiling panel, the first closure plate 79' can therefore be removed without binding onto the abutting ceiling panel or ceiling support apparatus.

In an alternative example, a portion of the first port 78' is defined in a portion of both the first and second panels 66, 67. Here, the defined portion of the first port in the first panel is spaced from the first side edge 70 of the first panel 66 of the first angled cover 65' the predetermined distance, as discussed above. In this example, portions of the first closure plate 79' are positioned at an angle with each other that is complementary to the angle formed between the first and second panels 66, 67 of the first angled cover along angled edge 68.

The at least one angled cover 65, as discussed above, can also include a second angled cover 65" (FIG. 1). In this example, the first side edge 70 of the first panel 66 of the second angled cover 65" is connected to a portion of the second longitudinally extending side edge 29 of the base member 22 and the second side edge 72 of the second panel 67 of the second angled cover is connected to a portion of the base top surface 31 of the base member. Similar to the first angled cover, the second angled cover extends between the first end wall 62 and the second end wall 64 of the housing 60 such that portions of the first and second end walls 62, 64, portions of the second angled cover 65", and portions of the base top surface 31 together define a second ballast enclosure 74". The second ballast enclosure can remain empty or a second ballast 76" can be positioned within the interior of the second ballast enclosure as the electrical demands of the use of the light fixture dictate. As one will appreciate, the second ballast can be in electrical communication with the light source and the external power source.

Accordingly, and still referring to FIG. 1, a portion of the second angled cover can define a second port 78" adjacent the angled edge 68 that is in communication with the second ballast enclosure 74". A second closure plate 79" is provided that is constructed and arranged for releasable connection to the second angled panel 65" such that, in a closed position, the second closure plate 79" is in substantial registration with the second port. Thus, the second ballast 78" positioned in the second ballast enclosure 74" can be selectively enclosed.

In one aspect, therefore, at least a portion of the second port 78" is defined in a portion of the first panel 66 of the second angled cover 65" and is spaced from the first side edge 70 of the first panel 66 the predetermined distance, as discussed above, for clearance from abutting ceiling panels. Alternatively, at least a portion of the second port 78" is defined in the second panel 67 of the second angled cover. In one other embodiment, at least a portion of the second port 78" is defined in a portion of the first panel 66 of the second angled cover (spaced from the first side edge 70 of the first panel the predetermined distance) and at least a portion of the second port 78" is defined in a portion of the second panel 67 of the second angled cover 65". Here, portions of the second closure plate 79" are positioned at an angle with respect to each other that is complementary to the angle formed between the first and second panels 66, 67 of the second angled cover 65" along angled edge 68.

In an alternative embodiment, suitable for retrofit applications, the housing can be a pre-existing housing that, for example, is conventionally mounted in a ceiling. In this embodiment, the reflector assembly of the present invention is connected to the pre-existing housing. In one aspect, at least a portion of the base member defines an access port. A movable cover (not illustrated) is provided in or on the reflector assembly that can be opened and closed by an operator to access a ballast that is disposed in an interior cavity formed between the back of the reflector assembly and portions of the pre-existing housing.

In an alternative embodiment, the light fixture is suspended from the ceiling. In this embodiment, the reflector assembly can be connected to a housing that defines an interior cavity sized to accept the electrical ballast therein. The housing is spaced from the ceiling a predetermined distance and is mounted to the ceiling via conventional suspension means. Alternatively, the ballast can be mounted onto a portion of the surface of the base member that is oriented toward the ceiling. Here, the base member is spaced from the ceiling a predetermined distance and is mounted to the ceiling via conventional mounting means.

As one will appreciate, it is contemplated that such a suspended light fixture could include one or of more hollows, as shown in FIG. 6. In a suspended light fixture having a single hollow, the respective first and second side edges of the hollow would extend to the edges of the base member. In an example having a pair of parallel hollows, the first hollow edge of the a first hollow extends to one side edge of the base member and the second hollow edge of the second hollow edge extends to the other side edge of the base member. In one aspect, the trough of the reflector assembly of the suspended light fixture is integral with a portion of an adjoined hollow. In another aspect, the reflector assembly of the suspended light fixture includes at least one end face that is positioned at an obtuse angle with respect to the base member of the top surface 31 of the reflector assembly.

Referring to FIGS. 1-6 and 8-15, the lens assembly 100 of the present invention is constructed and arranged to direct light emitted by the light source 12 onto the area to be illuminated. A basic function of the lens assembly 100 is to diffuse the light from the light source 12 to effectively hide the light source 12 itself from view while reducing its brightness. Thus, one function of the lens assembly is to effectively become the source of light for the light fixture. This is accomplished in the preferred embodiment by providing the lens 110 of the lens assembly with an array 120 of longitudinally extending prismatic elements 122 with short focal lengths. Because of the short focal lengths of the prismatic elements, the light from the light source is focused to parallel images very close to the surface of the lens at large angles of convergence. Because of the large angles of convergence, the images overlap and the light is essentially diffused. The diffused light is then either directed onto the surface to be illuminated without further reflection or is reflected by the reflective surfaces of the hollow 32. Thus, the lens assembly provides a diffuse source of lowered brightness.

As discussed above, the light source 12 is mounted in the trough and is recessed with respect to the side edges of the reflector assembly. This allows the lens 110 to be placed higher in the light fixture and provides geometric control of high-angle rays emanating from the lens in the transverse direction. Thus, light rays produced at high viewing angles are physically blocked by the bottom longitudinally extending side edges 28, 29 of the light fixture, which prevents glare at high angles in that transverse direction. The light fixture of the invention controls glare in the longitudinal direction, however, optically.

High angle glare is reduced in the longitudinal direction as illustrated in FIGS. 18-21 and as described below. Thus, in this aspect, the light fixture of the invention prevents glare at high viewing angles through two mechanisms, geometrically in the transverse direction and optically in the longitudinal direction.

In one aspect, the lens assembly 100 includes a lens 110 having a first end edge 112, an opposed second end edge 113, and a central lens portion 114 that extends between the first and second edges. The central lens portion 114 has a lens longitudinal axis that extends between the first and second end edges. In one example, the lens longitudinal axis is generally parallel to the light source longitudinal axis. In use, the lens 110 of the lens assembly is positioned with respect to the reflector assembly 20 of the light fixture such that substantially all of the light emitted by the light source 12 passes through the lens 110 prior to impacting portions of the reflective surfaces 33 of the reflector assembly and/or prior to being dispersed into the surrounding area.

The lens 110 can be made from any suitable, code-compliant material such as, for example, a polymer or plastic. For example, the lens 110 can be constructed by extruding pellets of meth-acrylate or polycarbonates into the desired shape of the lens. The lens 110 can be of a clear material or a translucent material. In another aspect, the lens can be colored or tinted.

Referring to FIGS. 5A-5C, the central lens portion 114 of the lens has a prismatic surface 116 on a face 118 of the central lens portion that is either spaced from and facing toward the light source 12 (FIG. 5A) or, alternatively, spaced from and facing away from the light source 12 (FIG. 5B). In one aspect of the invention, the central lens portion 114 is curved in cross-section such that at least a portion of the face 118 of the central lens portion has a concave or convex shape relative to the light source. In an alternative embodiment, at least a portion of the central lens portion 114 is planar in cross-section.

In one aspect, the lens 110 is positioned within the reflector assembly so that it is recessed above a substantially horizontal plane extending between the first and second longitudinally extending side edges 28, 29 thereof. In a further aspect, the lens is recessed within the reflector assembly such that a plane bisecting one of the respective first and second longitudinally extending side edges and a tangential portion of the lens is oriented at an acute angle γ to the generally horizontal plane extending between the first and second longitudinally extending side edges 28, 29. In one aspect, the acute angle γ is about and between 3° to 30°. More particularly, the acute angle γ is about and between 05° to 20°. Still more particularly, the acute angle γ is about and between 10° to 15°.

The recessed position of the lens assembly within the reflector assembly provides for high angle control of light emitted by the light fixture in a vertical plane normal to the base longitudinal axis of the base member. In use, an observer approaching the ceiling mounted light fixture of the present invention from the side (i.e., from a direction transverse to the base longitudinal axis) would not see the lens assembly until they passed into the lower viewing angles. In effect, portions of the reflector assembly act to block the view of the lens assembly from an observer at the higher viewing angles (i.e., the viewing angles closer to the horizontal ceiling plane).

In one aspect, as shown in FIGS. 8-17, the prismatic surface 116 of the lens defines an array of linearly extending prismatic elements 120. In one example, each prismatic element 122 of the array 120 can extend substantially longitudinally between the first and second edge and edges 112, 114 of the lens. Alternatively, each prismatic element 122 of the array can extend linearly at an angle relative to the lens longitudinal axis. For example, each prismatic element thereof can extend generally transverse to the lens longitudinal axis. In a further aspect, each prismatic element 122 can have substantially the same shape or, alternatively, can vary in shape to cause differing visual effects on an external observer, lighting of the hollow surface, or light distribution to the room. In one aspect, each prismatic element has a portion that is rounded or has a curved surface.

In one aspect, in section normal to the lens longitudinal axis, each prismatic element has a base 124 and a rounded apex 126. Each prismatic element extends toward the apex 126 substantially perpendicular with respect to a tangent plane that extends through the base 124. In one aspect, an arcuate section or curved surface 128, normal to the lens longitudinal axis, of each prismatic element 122 subtends an angle β of about and between 85° to 130° with reference to the center of curvature of the arcuate section. More particularly, the arcuate section 128 of each prismatic element forms an angle β of about and between 90° to 120°. Still more particularly, the arcuate section 128 forms an angle β of about and between 95° to 110°. In another aspect, the arcuate section 128 forms an angle β of about 100°.

In one aspect, the arcuate section 128 extends from a first cusp edge 130 of the prismatic element 122 to an opposed second cusp edge 132. In this example, adjoining prismatic elements are integrally connected at a common cusp edge. Alternatively, the arcuate section 128 may be formed in a portion of the apex 126 of the prismatic element 122, such that adjoining prismatic elements are integrally connected along the common edge 133. In this example, portions of the prismatic element 122 extending between the arcuate section and the common edge 133 can be planar or non-planer, as desired. It should be understood that other configurations and shapes are contemplated where the cross section of the optical elements is not strictly circular, and include, for example, parabolic, linear, or other shapes.

In one aspect, the base 124 of each prismatic element 122 has a width (w) between its respective common edges of about and between 0.5 inches to 0.01 inches. More particularly, the base of each prismatic element has a width between its respective common edges of about and between 0.3 inches to 0.03 inches. Still more particularly, the base of each prismatic element has a width between its respective common edges of about and between 0.15 inches to 0.05 inches.

Figure 11:
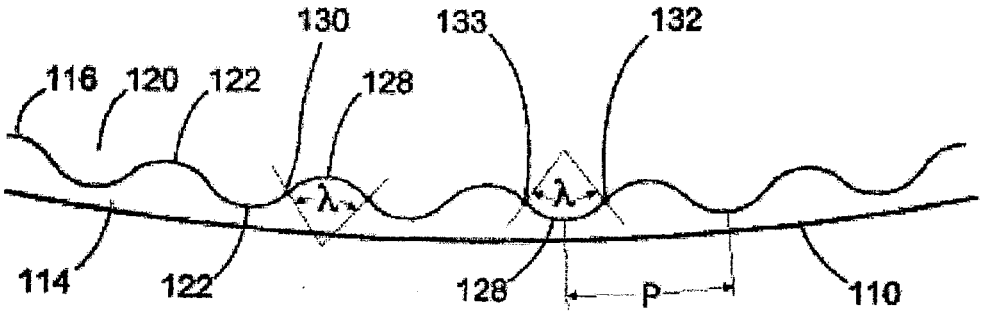
FIG. 11 is an enlarged partial cross-sectional view of the lens assembly, showing an alternative embodiment of the array of prismatic elements.
Figure 12:
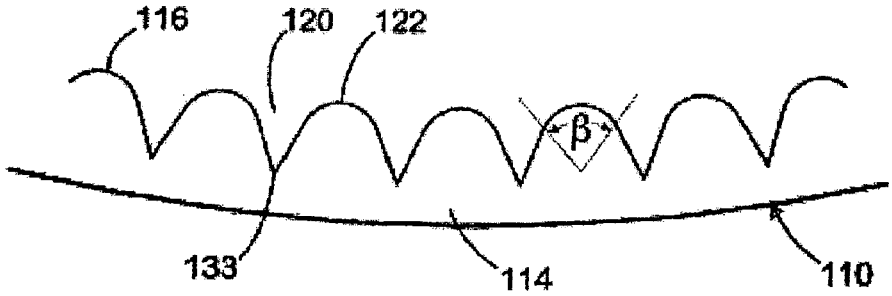
FIGS. 12 and 13 are enlarged partial cross-sectional views of the lens assembly, showing additional alternative embodiments of the array of prismatic elements.
Figure 13:
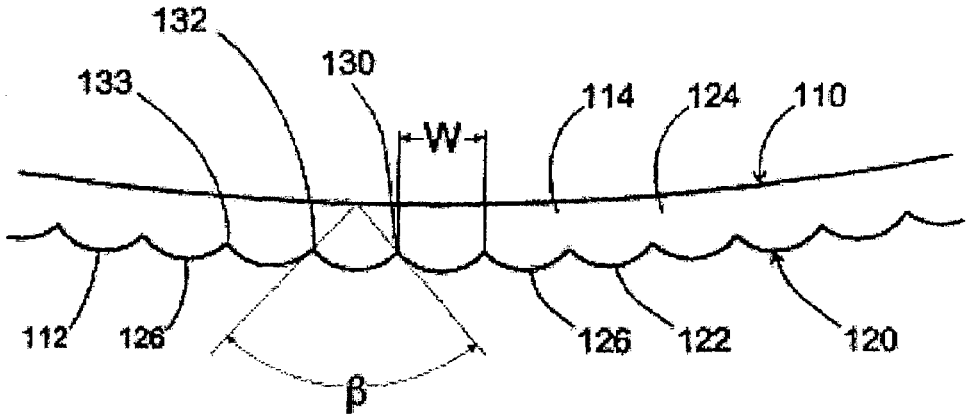
Figure 14:
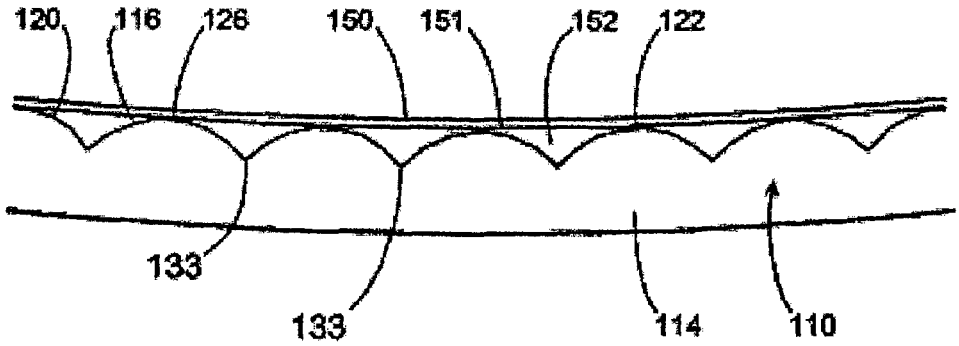
FIG. 14 shows an enlarged partial cross-sectional view of one embodiment of the lens assembly of the present invention with the diffuser inlay in registration with a portion of the prismatic surface of the lens.
Figure 15:
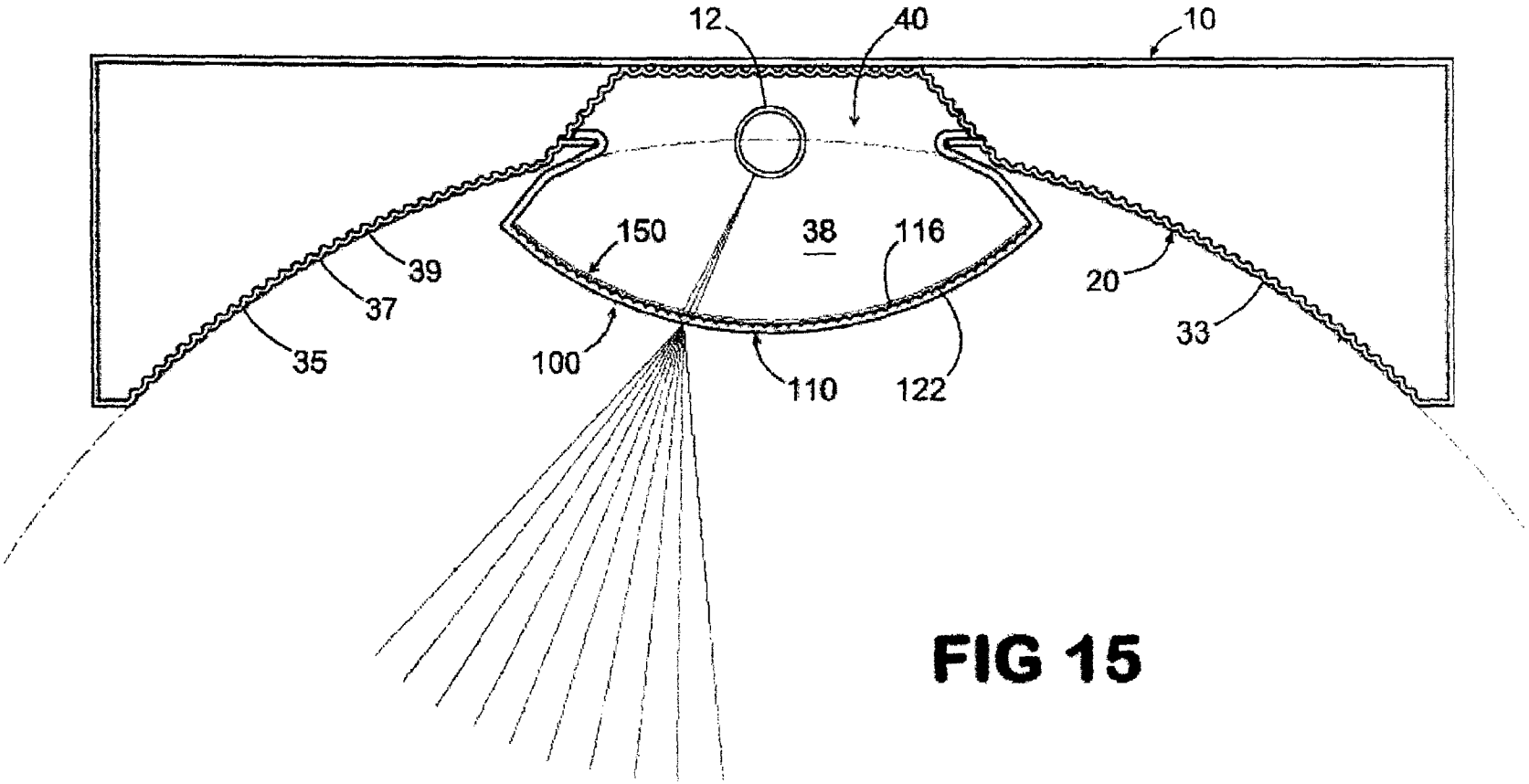
FIG. 15 is a partial cross-sectional view of the light fixture of FIG. 3, taken along line 15-15, showing exemplary paths of light emitted from a high-intensity light source housed within the light fixture above the ceiling plane.
Figure 16:
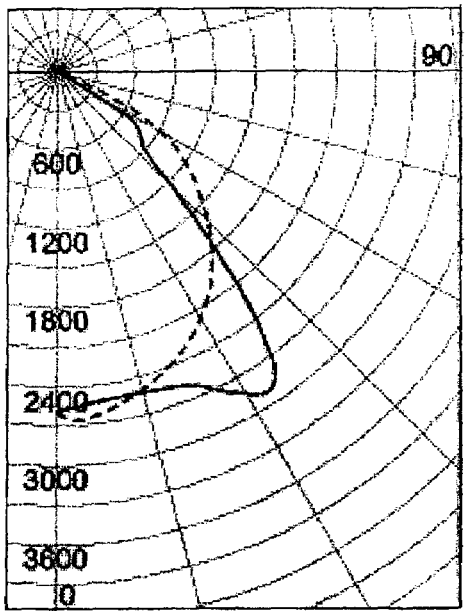
(PRIOR ART) FIG 16
FIG. 16 shows illumination test results for an exemplary prior art 3-lamp T8 parabolic troffer.
Figure 17:
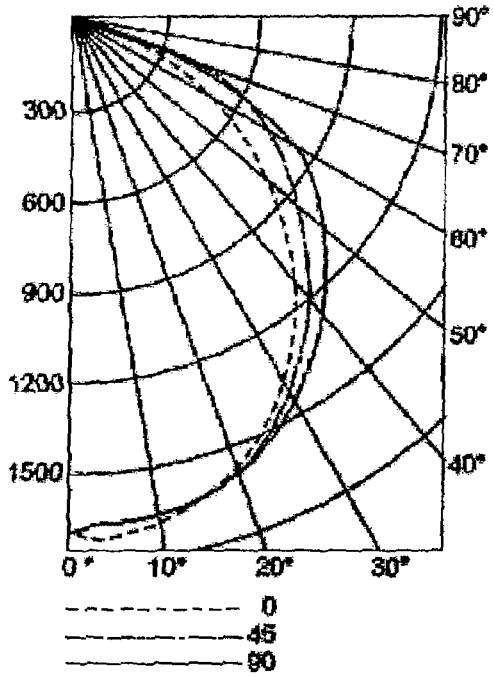
FIG. 17 shows illumination test results for an exemplary 2-lamp T5 light fixture of the present invention.
Figure 18:
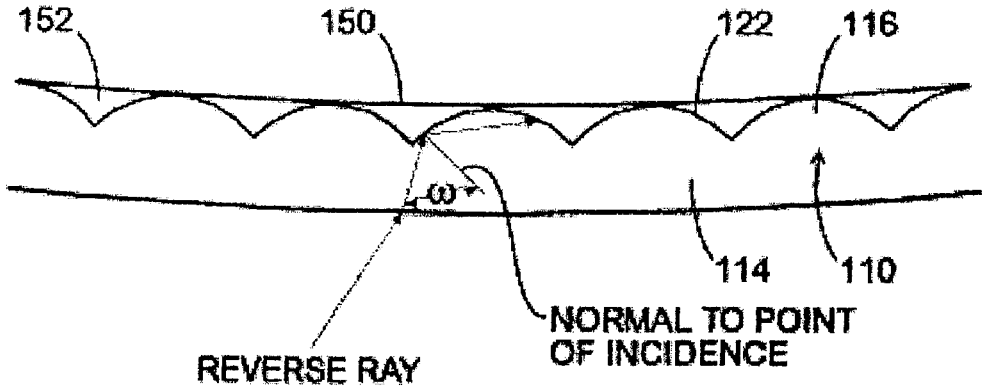
FIG. 18 shows an exemplary path of a reverse ray of light, in a vertical plane transverse to the longitudinal axis of the light fixture, entering a face of the lens oriented away from the light source.
Figure 19:
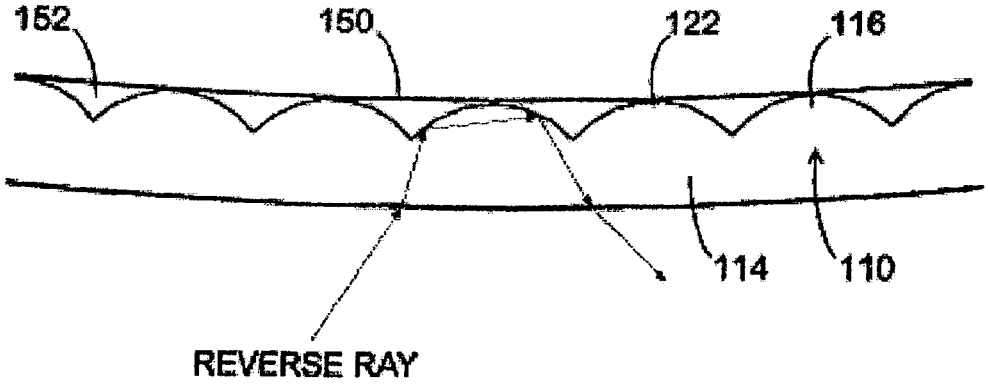
FIG. 19 shows an exemplary path of a reverse ray of light, in a vertical plane transverse to the longitudinal axis of the light fixture, being rejected out of a face of the lens, the face being that is oriented away from the light source.
Figure 20:
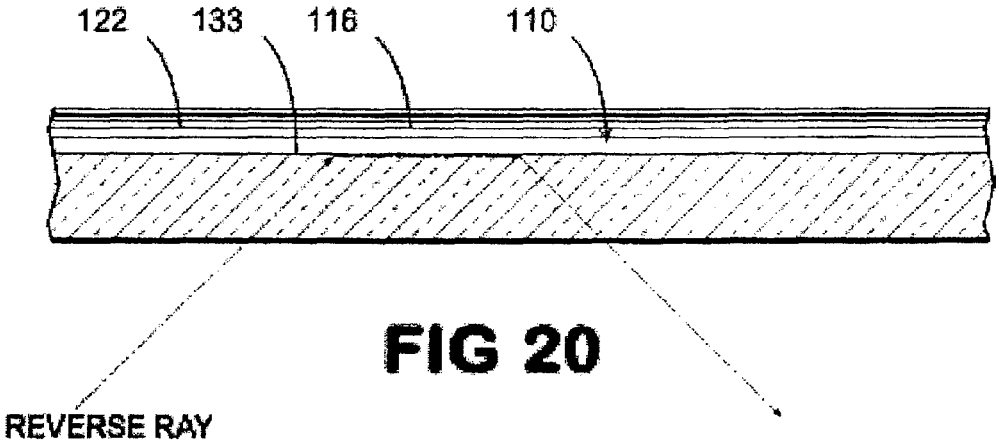
FIG. 20 shows an exemplary path of a reverse ray of light, in a vertical plane parallel to the longitudinal axis of the light fixture, entering a face of the lens and being rejected out of the face of the lens, the face being oriented away from the light.
Figure 21:
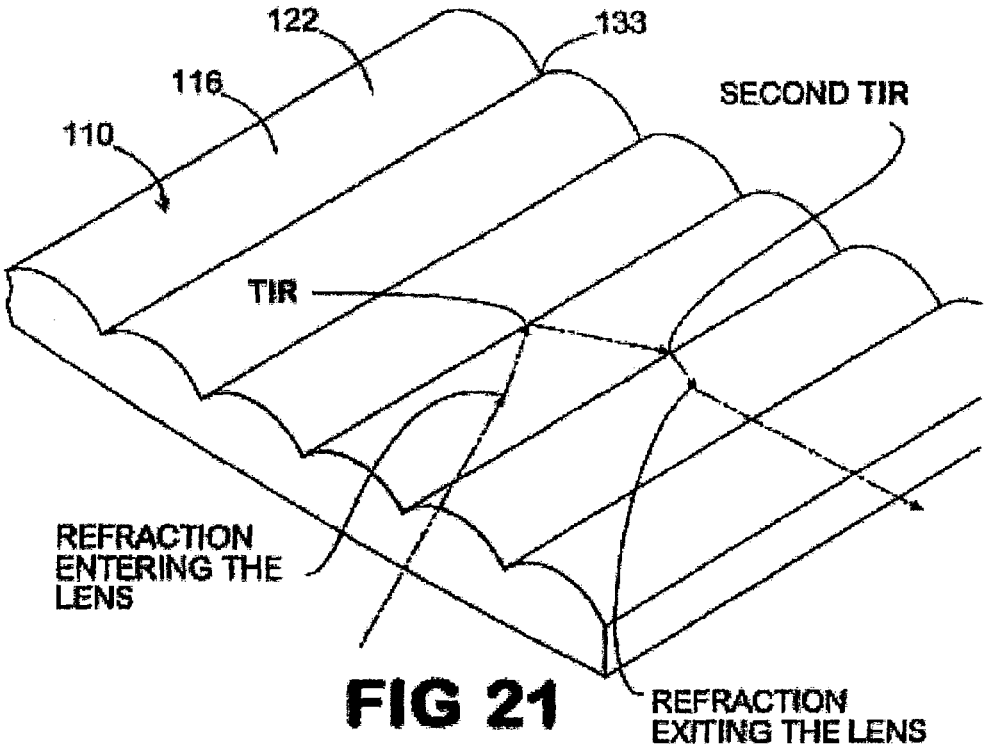
FIG. 21 is a perspective view of the exemplary path of a reverse ray of light.
Figure 22:
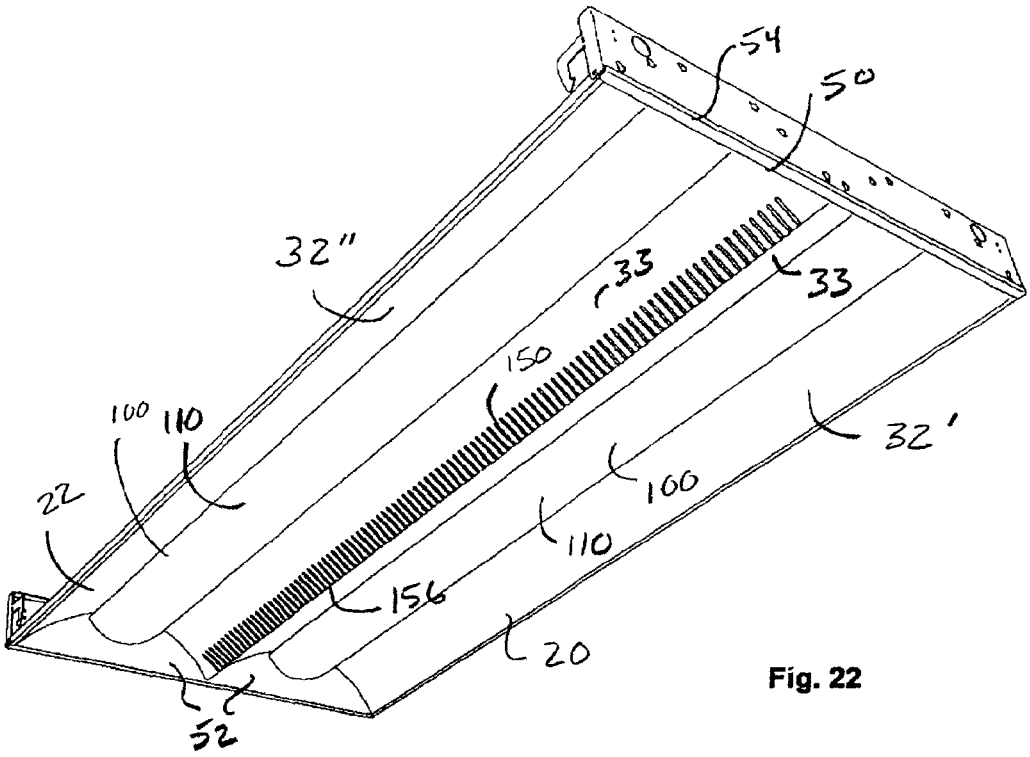
FIG. 22 is a bottom perspective view of one embodiment of an air handling light fixture of the present invention, showing a plurality of air slots positioned in an array of air slot on a common edge between the first and second hollows of the light fixture.
Figure 23:
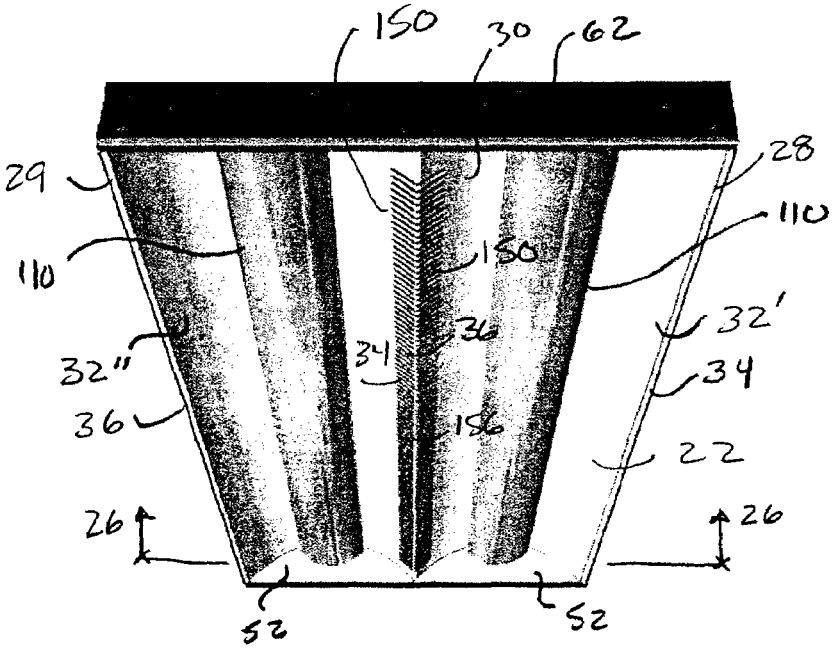
FIG. 23 is an end bottom perspective view of the light fixture of FIG. 22, showing the air slots positioned substantially transverse to the base longitudinal axis of the base member.
Figure 24:
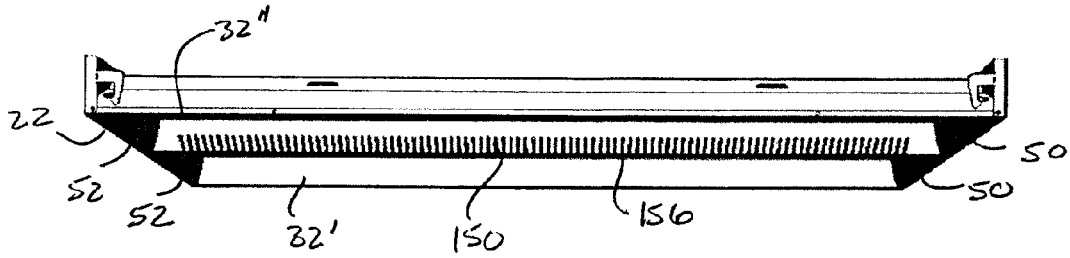
FIG. 24 is a side bottom perspective view of the light fixture of FIG. 22.
Figure 25:
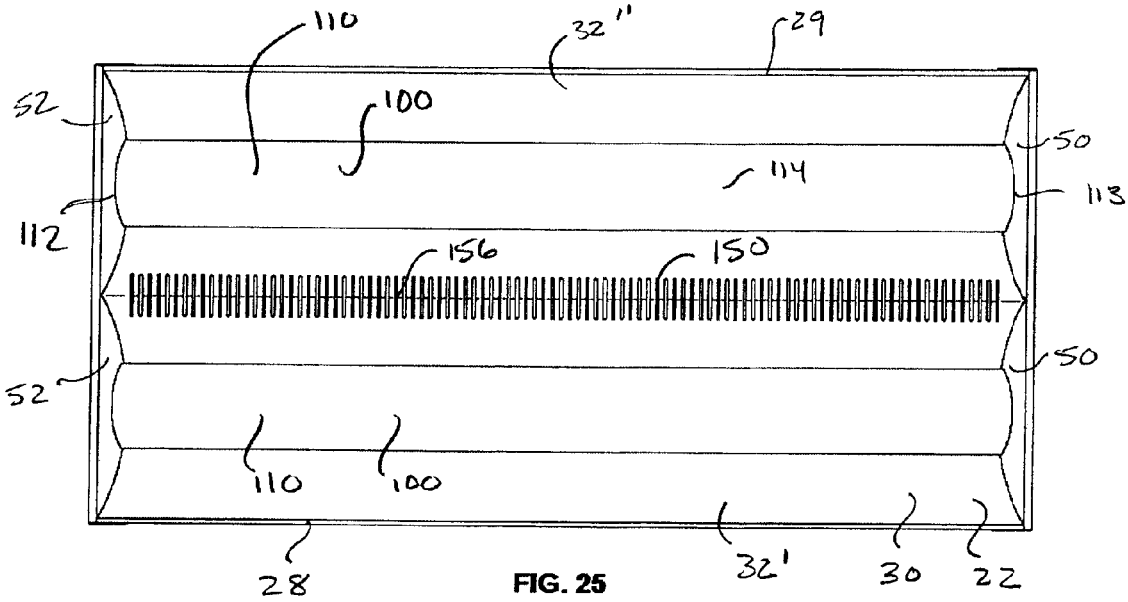
FIG. 25 is a bottom elevational view of the light fixture of FIG. 22.
Figure 26:
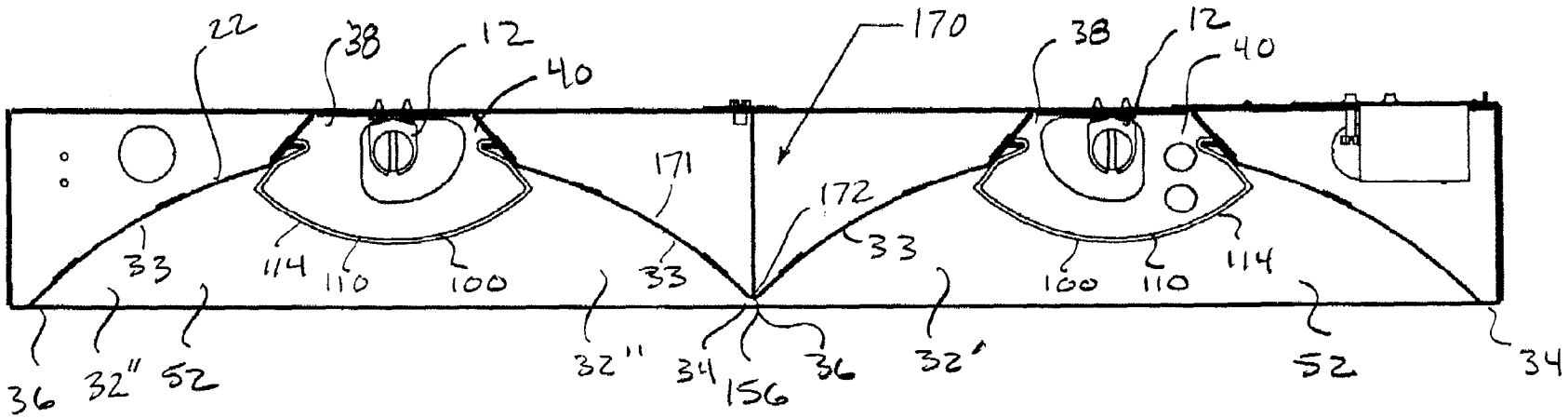
FIG. 26 is a cross-sectional view of the light fixture of FIG. 23, taken along line 26-26, showing a deflector member connected to the housing and extending proximate to the upper surface of the base member and to the common edge between the first and second hollows.
Figure 27A:
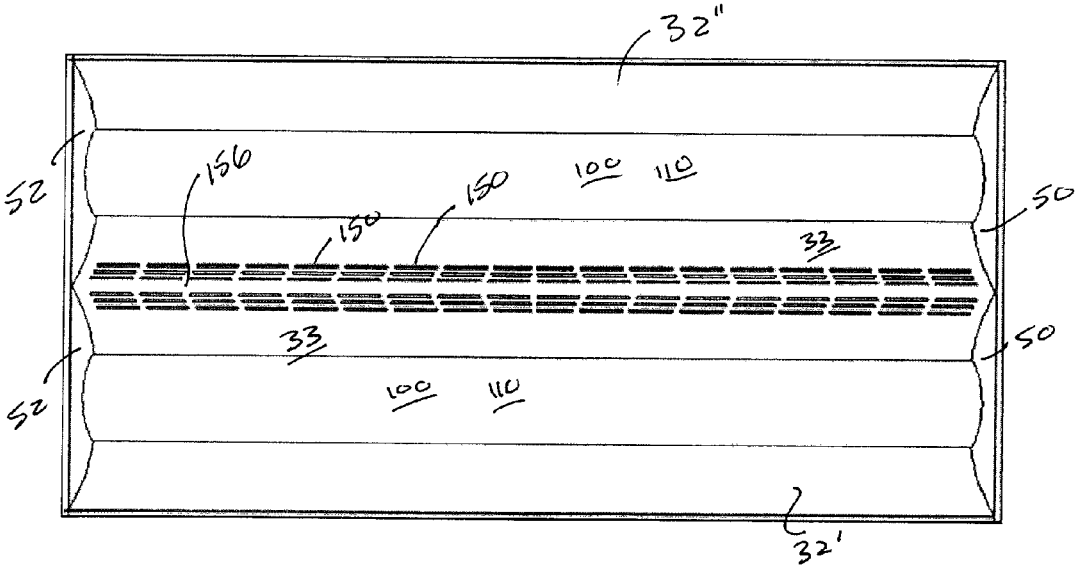
FIG. 27A is a bottom elevational view of an embodiment of an air handling light fixture, showing the plurality of air slots defined on each of the first and second hollows and spaced from the common edge between the hollows. In this example, each air slot longitudinal axis is substantially parallel to the base longitudinal axis.
Figure 27B:
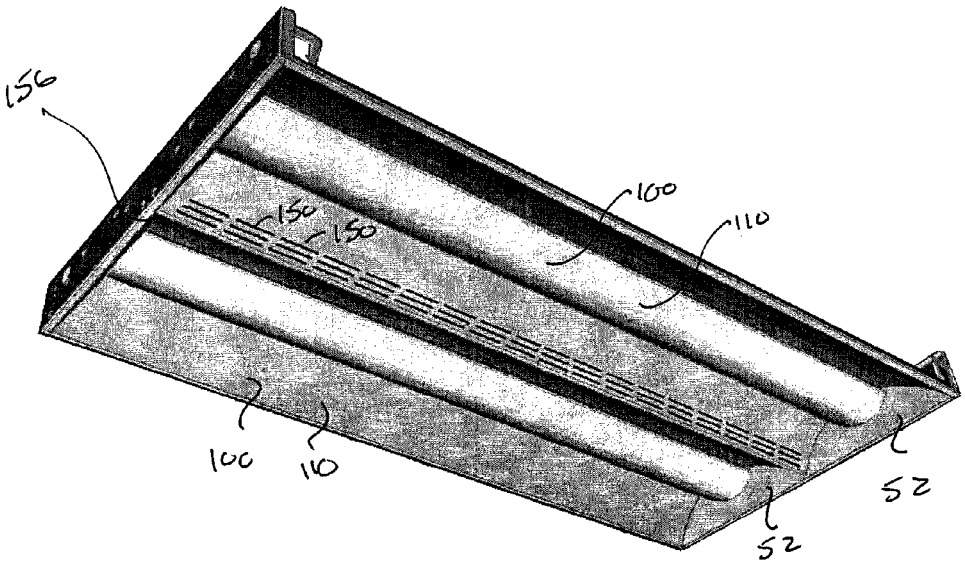
FIG. 27B is a bottom perspective view of the light fixture of FIG. 27A.
Figure 28:
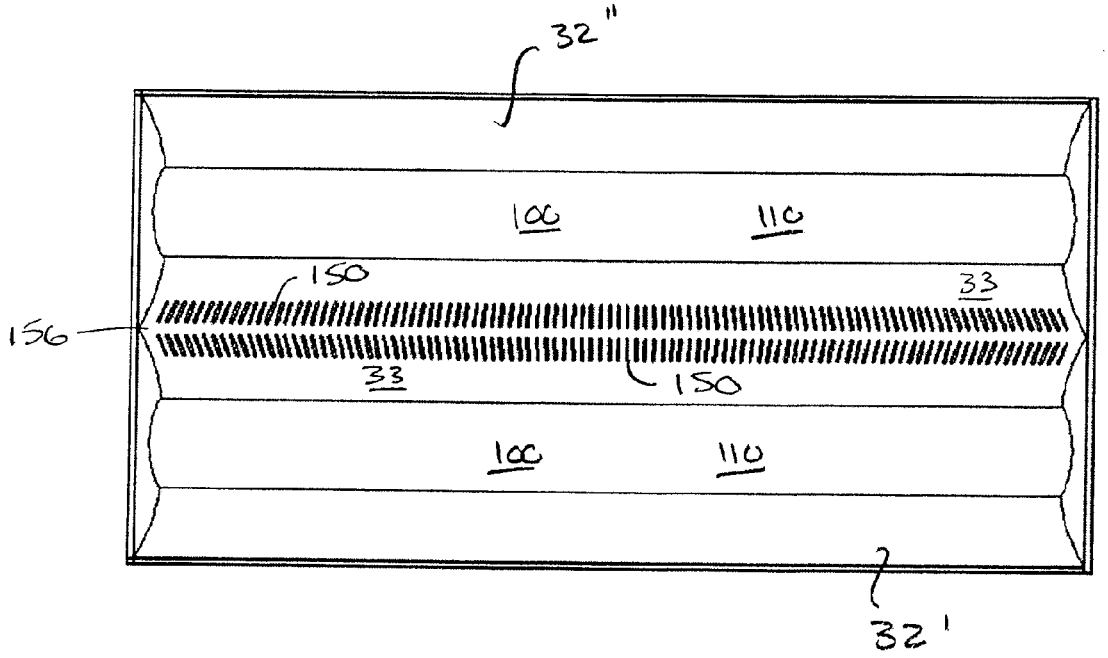
FIG. 28 is a bottom elevational view of an embodiment of an air handling light fixture, showing the plurality of air slots defined on each of the first and second hollows and spaced from the common edge between the hollows. In this example, each air slot longitudinal axis is substantially transverse to the base longitudinal axis.
Figure 29:
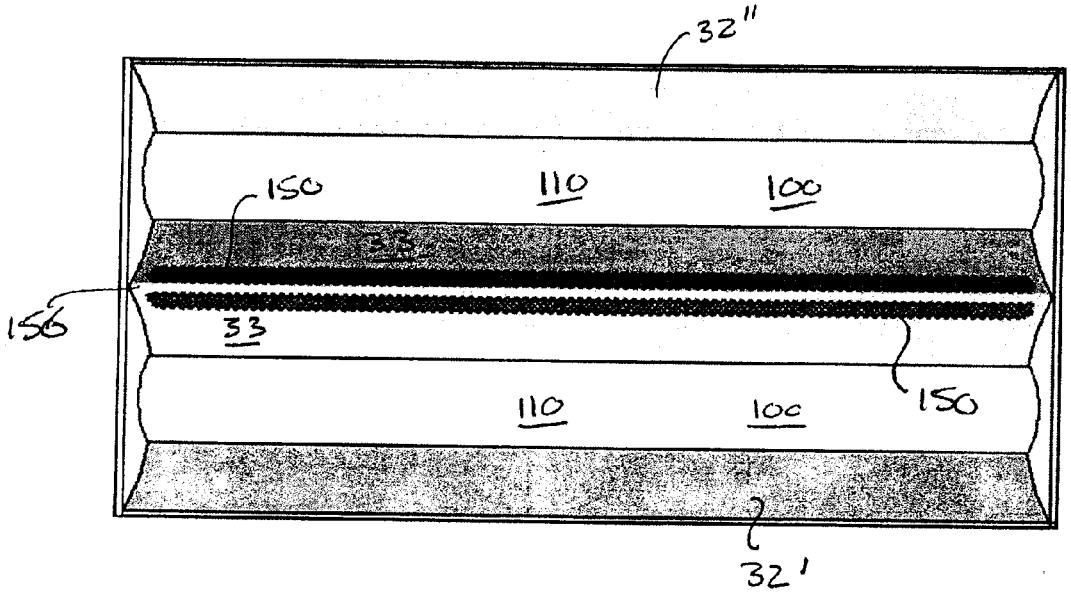
FIG. 29 is a bottom elevational view of one embodiment of an air handling light fixture, showing a plurality of air slots or perforations defined in the respective first and second hollows of the light fixture intermediate the common edge of the hollows and each respective lens assembly.
Figure 30:
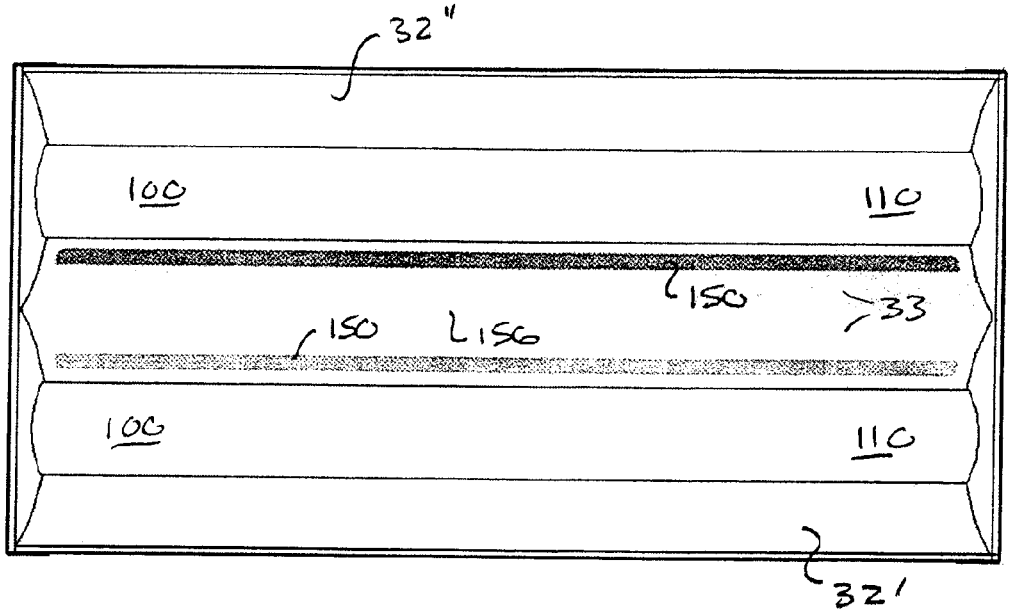
FIG. 30 is a bottom elevational view of one embodiment of an air handling light fixture, showing a plurality of air slots or perforations defined in the respective first and second hollows of the light fixture intermediate the common edge of the hollows and each respective lens assembly.

In another aspect, as shown in FIG. 11, a section of the array of prismatic elements 120 has a shape of a continuous wave. The section can be normal to the lens longitudinal axis. In one aspect, the shape of the continuous wave is a periodic waveform that has an arcuate section 128 formed in both the positive and negative amplitude portions of the periodic waveform (i.e., two prismatic elements are formed from each single periodic waveform). The period of the periodic waveform can be substantially constant or may vary along the array of prismatic elements. In one aspect, the periodic waveform is a substantially sinusoidal waveform. In this example, the common cusp "edge" 130,132 between the two prismatic elements 122 forming from each periodic waveform occurs at the transition from positive/negative amplitude to negative/positive amplitude.

As shown in FIG. 11, therefore, the arcuate section 128 of each prismatic element 122 within each of the positive and negative amplitude portions of the periodic waveform subtends an angle λ of about and between 85° to 130° with reference to a center of curvature of the arcuate section. More particularly, the arcuate section 128 of each prismatic element within each of the positive and negative amplitude portions of the periodic waveform forms an angle λ of about and between 90° to 120°. Still more particularly, the arcuate section 128 of each prismatic element within each of the positive and negative amplitude portions of the periodic waveform forms an angle λ of about and between 95° to 110° with respect to the base longitudinal axis. In another aspect, the arcuate sections 128 within each of the positive and negative amplitude portions of the periodic waveform form an angle λ of about 100°.

Still referring to FIG. 11, in one aspect, the period P of each prismatic element is about and between 1.0 inches to 0.02 inches. More particularly, the period P of each prismatic element is about and between 0.6 inches to 0.06 inches. Still more particularly, the period P of each prismatic element is about and between 0.30 inches to 0.10 inches.

The lens 110 of the light assembly 100 is constructed and arranged for detachable connection to the light fixture 10 or troffer. In one aspect, when positioned relative to the base member 22, the central lens portion 114 of the lens assembly can extend generally parallel to the light source longitudinal axis and generally symmetric about a plane that extends through the light source longitudinal axis. In one other aspect, the plane of symmetry extends through the area desired to be illuminated. In one example, the lens 110 is constructed and arranged for detachable connection to a portion of the base surface 30 of the reflector assembly 20. In one particular example, the lens 110 is constructed and arranged for detachable connection to a portion of the trough 20 defined in the base member 22.

In one aspect, the elongated lens 110 has a first arm 140 (FIG. 9) that is connected to a first lens edge 115 of the central lens portion 114 and a second arm 142 that is connected to a second lens edge 117 of the central lens portion 114. A portion of the each respective first and second arm 140,142 is configured for being detachably secured to portions of the trough 40. In one example, a portion of the first arm 140 is constructed and arranged for being detachably secured to a portion of the first side trough surface 44 (FIG. 5A) and a portion of the second arm 142 is configured for being detachably secured to a portion of the second side trough surface 46.

In one example, each of the first and second side trough surfaces 44, 46 has at least one male protrusion 45 (FIG. 6), for example, a tab extending inwardly into the interior of the trough 40. Each of the first and second arms 140, 142 of the lens 110 has an end portion 144 that is sized and shaped for detachable engagement with the at least one male protrusion 45 in each of the respective first and second trough surfaces. Alternatively, each of the first and second side surfaces 44, 46 can define at least one slot 47 (FIG. 2) that is constructed and arranged to complementarily engage a male protrusion 145 projecting from the end portion 144 of each of the respective first and second arms 140, 142 of the lens. In use, the lens 110 may be removed from the reflector housing by applying force to the respective first and second lens edges 115, 117 of the central lens portion 114. The application of force causes the central lens portion 114 to bend and, resultantly, causes the respective end portions 144 of the first and second arms 140, 142 to move toward each other. Removal of the applied force allows the lens 110 to return toward its unstressed shape and allows the respective end portions 144 of the first and second arms 140, 142 to move away from each other.

In one aspect, each of the first and second arms of the lens has a bottom portion 146 (FIG. 9) that is connected to the respective first and second lens edges 115, 117 and extends toward the end portions 144 of the respective arms 140, 142. The bottom portion 146 can be planar or non-planer in shape. In one example, the bottom portion 146 extends substantially between the first end edge 112 and the second end edge 113 of the lens.

As shown in FIG. 5A, in one example, where the lens 110 is detachably secured to the trough 40 of the reflector assembly 20, a portion of the bottom portion 146 of each of the first and second arms of the lens is detachably positioned adjacent to a portion of the respective lower edges 48 of the first and second side trough surfaces 44, 46. In one aspect of the invention, a portion of the bottom portion 146 of each of the first and second arms 140, 142 of the lens 110 is positioned at an acute angle with respect to the reflective surface 33 of the hollow 32 adjacent the respective lower edge 48 of the first and second trough surfaces 44, 46. In this example, the portion of the bottom portion 146 of each of the first and second arms of the lens overlies a portion of the reflective surface 33 of the hollow 32 adjacent the respective lower edge 48 of the first and second trough surfaces. Here, the distance between the respective first and second lens edges 115, 117 of the lens 110 is greater than the distance between the respective lower edges 48 of the first and second side trough surfaces 44, 46.

In the embodiment described immediately above, each of the respective first and second lens edges 115, 117 is spaced from and overlies a portion of the reflective surfaces 33 of the hollow 32. Alternatively, and as shown in FIGS. 5B and 5C, the respective first and second lens edges 115, 117 may be positioned adjacent a portion of the respective lower edges 48 of the first and second side trough surfaces 44, 46. In this particular embodiment, the lens 110 generally does not overly a portion of the curved reflective surface 33 of the hollow.

In one aspect, portions of the lens 110 that are positioned adjacent the surface of the reflective assembly 20 are sized and shaped to be in close overlying registration with portions of the reflector assembly when the lens 110 is detachably secured to the reflector assembly 20. For example, each of the respective first and second ends 112, 113 of the lens are sized and shaped to be positioned adjacent to and in close overlying registration with portions of the reflector assembly 20, such as, for example, portions of the first and second end faces, if used. Thus, the light source 12 housed within the trough 40 of the reflector assembly 20 is substantially enclosed when the lens 110 is detachably secured to the reflective assembly.

In one aspect, when the lens assembly is positioned within the reflector assembly, the light source is positioned below a plane bisecting the respective first or second longitudinally extending side edges 28, 29 of the base member 22 and the adjacent respective first or second lens edges 115, 117. In this example, the relative position and shape of the reflector assembly and the lens assembly would prevent an observer, approaching the light fixture from a direction transverse to the base longitudinal axis, from viewing the light source through the bottom portion of the respective first or second arms of the lens.

The lens assembly 100 can also include a conventional diffuser inlay 150 (FIG. 9), such as, for example, a OptiGrafix™ film product, which is a diffuser film that can be purchased from Grafix® Plastics. The diffuser inlay 150 can be pliable or fixed in shape, transparent, semi-translucent, translucent, and/or colored or tinted. In one example, the diffuser inlay 150 has relatively high transmission efficiency while also scattering a relatively high amount of incident light to angles that are nearly parallel to its surface. In one aspect, the diffuser inlay is positioned between a portion of the face 118 of the central lens portion and the light source 12. In another aspect, the diffuser inlay is sized and shaped for positioning in substantial overlying registration with the portion of the face 118 of the central lens portion 114 that is oriented toward the light source 12.

The diffuser inlay 150 may be positioned in substantial overlying registration with a portion of the prismatic surface 116 of the central lens portion 114. In one aspect of the present invention, there is a gap 152 formed between portions of the two adjoining rounded prismatic elements 122 extending between the respective apexes of the two adjoined prismatic elements and the bottom face 151 of the diffuser inlay 150. The formed gap enhances the total internal refection capabilities of the lens assembly 100.

Referring to FIGS. 16-21, the lens assembly 100 and reflector assembly 20 of the present invention increase the light efficiency of the light fixture 10 and diffuse the light relatively uniformly so that the "cave effect" commonly noted in areas using conventional parabolic light fixtures in the ceiling are minimized. In one embodiment, the light fixture 15 or troffer of the present invention results in a luminare efficiency that is greater than about 80%, preferably greater than about 85%. The efficiency of the light fixture 10 measured by using a goniophotometer to compare the light energy from the light fixture at a given angle with the light from an unshielded light source, as specified in the application testing standard. The test results for an exemplary light fixture of the present invention and comparable results for a conventional parabolic light fixture are included in FIGS. 16 and 17. The light fixture of the present invention has reduced light control relative to conventional parabolic fixtures to provide a lit space (particularly the walls) with a bright appearance while still maintaining adequate control and comfortable viewing for today's office environment.

The light fixture 10 of the present invention has a low height profile that allows for easy integration with other building systems and installations in low plenum spaces. In one aspect, the height profile of the light fixture is about or below 5 inches. More particularly, the height profile of the light fixture is about or below 4 inches. In another aspect, the height profile of the light fixture is about 3.25 inches.

In one embodiment of the lens assembly 100 discussed above, the central lens portion 114 of the lens 110 has a concave face 118 oriented toward the light source 12 when the lens 110 is detachably secured to and within a portion of the reflector assembly 20. The array of male rounded prismatic elements 120 can be extruded along the length of the lens 110. In use, the lens of the present invention design has a striped visual characteristic to an external observer when back lit. These "stripes" provide for visual interest in the lens 110 and may be sized and shaped to mirror any ridges or grooves disposed therein portions of the reflective surfaces 33 of the hollow 32 of the reflector assembly 20. The "stripes" also help to mitigate the appearance of the image of the lamp (the light source) by providing strong linear boundaries that breakup and distract from the edges of the lamp against the less luminous trough 40 of the reflector assembly 20. In addition, the "stripes" allow for the light fixture 10 of the present invention to provide high angle light control in vertical planes that are substantially parallel to the longitudinal axis of the light fixture.

In a preferred embodiment, a primary function of the lens is to optically reduce the brightness of the light source. In addition, the lens reduces the brightness of the light source even further at higher viewing angles in the longitudinal direction by the optical phenomenon of total internal reflection. This allows the efficient use of light sources of higher brightness while nevertheless reducing glare at high viewing angles.

It will be appreciated that the light fixture of the invention utilizes a unique combination of features to reduce high-angle glare in the transverse and longitudinal directions. In the transverse direction, high angle glare is controlled primarily by the geometric relationship between the lamp and the reflector assembly of the light fixture, as discussed above, while in the longitudinal direction, high angle glare is controlled primarily by the lens optically. In the preferred embodiment, the lens itself essentially becomes the light source, which effectively reduces lamp brightness in both the transverse and longitudinal directions optically, to further reduce glare associated with lamps of high brightness.

Referring now to FIGS. 18-21, the optical creation of the dark "stripes" in the lens is illustrated. A "reverse ray," "backward ray" or "vision ray" is a light ray that originates from a hypothetical external viewer's eye and is then traced through the optical system of the light fixture. Although there is no physical equivalent, it is a useful construct in predicting how a particular optical element will look to an observer. In the present invention, on at least one side at the respective common cusp edges 130, 132, 133 of adjoining rounded prismatic elements 122, there exists a sufficiently large angle of incidence $\omega$ relative to the normal extending from the point of incidence of the reverse ray at the lens to air interface that a reverse ray will undergo total internal reflection. In one aspect, the angle of incidence $\omega$ is at least about 40°. More particularly, the angle of incidence $\omega$ is at least about 45. Still more particularly, the angle of incidence $\omega$ is at least about 50°. In effect, the array of prismatic elements acts as an array of partial light pipes.

Each rounded prismatic element 122 has a sufficiently large angular extent such that some total internal reflection at each common cusp edge is assured regardless of viewing angle. In one aspect, since each curved surface, or arcuate section, 128 of each rounded prismatic element 122 is substantially circular, if a reverse ray undergoes total internal reflection at one portion of the arcuate section and is subsequently reflected to another portion of the arcuate section, then total internal reflection will also occur at the second point of incidence because the arcuate section's geometry causes both interactions to have substantially the same angle of incidence. Generally then, a reverse ray that undergoes total internal reflection proximate a common cusp edge 133 will eventually exit the lens 110 out the same outer surface through which it entered the lens and will terminate on a surface or object in the room (as opposed to passing through the lens and terminating on the light source or the trough of the reflector assembly behind the lens). The reverse ray is said to be "rejected" by the lens. This means that the brightness an external viewer will perceive at the common cusp edge 133 of adjoining rounded prismatic elements 122 is the brightness associated with a room surface because any real/forward light ray impinging on the viewer's eyes from this part of the lens must have originated from the room or space. Generally, the brightness of an object or surface in the room is much lower than that of the light source or trough that is viewed through the central portions of the arcuate sections 128 of each prismatic element 122. This high contrast in brightness between the common cusp edge 133 between adjoining rounded prismatic elements 122 and the central portion of the arcuate sections 128 of each prismatic element 122 is so high that it is perceived, to the external viewer, as dark stripes on a luminous background.

The linear array 120 of prismatic elements 122 of the lens 100 assembly optically acts in the longitudinal direction to reduce high angle glare. This may be explained by considering a reverse ray that is incident on a portion of the prismatic surface of the lens proximate the common cusp edge 133 at the critical angle (the minimum angle of incidence $\omega$) for total internal reflection of the reverse ray. An observer viewing that portion of the lens (i.e., the portion of the area about the common cusp edge) would perceive it as being "dark" relative to that adjacent "bright" portion of the arcuate section proximate the rounded apex of each individual prismatic element. The array of linear elements thus optically controls the light emitted from the lamp in the longitudinal direction.

In one example, as the lens 110 is viewed at higher and higher viewing angles (as when the observer is further from the light fixture) in a vertical plane parallel or near parallel to the base longitudinal axis of the base member, the striping effect visible on the surface of the lens becomes more pronounced. This is a result of the increase in that portion of the prismatic surface of the lens that undergoes total internal reflection and creates the dark strips. This results from viewing the lens at angles greater than the critical angle for total internal reflection of a "reverse ray." Thus, the effective width of each stripe grows as the lens is viewed at higher viewing angles, which is observed as the lens becoming dimmer at higher viewing angles.

In the vertical planes extending between the base longitudinal axis of the reflector assembly base member and an axis transverse to the base member longitudinal axis, higher view angle control is achieved through a combination of the high angle control proffered by the linearly extending array of prismatic elements of the lens, as discussed immediately above, and the lens assembly being recessed within the reflector assembly. In the vertical plane substantially parallel to the base longitudinal axis of the reflector assembly, the optical elements of the lens assembly, i.e., the array of prismatic elements, exert primary glare control of the higher viewing angles. In the vertical plane substantially transverse to the base longitudinal axis of the reflector assembly, the recessed position of the lens assembly within the reflector assembly exerts primary glare control of the higher viewing angles.

In one aspect, if the prismatic elements 122 are regularly spaced apart, the striping effect would also be regularly spaced. In another aspect, the prismatic elements 122 of the present invention can be sized and shaped to ensure some total internal reflection at all viewing angles so that the "striping" is perceptible at all viewing angles.

In use, normal movement of a viewer in the room does not change the viewer's vertical angle of view relative to the light fixture very rapidly and at far distances the stripes become less distinct. Therefore, the change is stripe width is not perceived as a dynamic motion but rather as a subtle changing of the overall lens brightness (i.e., brighter at low vertical angles and dimmer when viewed at high vertical angles).

The rounded or curved surface portions of each prismatic element 122 provide a wide spreading or diffusion of any incident light. The high degree of diffusion helps to obscure the image of the light source 12 as seen through the lens 110 even when the light source is in relatively close proximity to the face of the lens 110 that is oriented toward the light source. This becomes increasingly apparent as the lens is viewed at higher vertical angles in the vertical plane substantially parallel to the light source.

In another aspect, the rounded or curved surface portions of the prismatic elements 122 provide for a gradual change in the perceived brightness as a result of a change in the angle of view. In yet another aspect, in an embodiment of the invention in which each prismatic element 122 has substantially the same shape, the dark striping and the brighter areas of the lens 110 appear to change uniformly and smoothly from one prismatic element 122 to the next, adjoining prismatic element 122.

Referring now to FIGS. 22-32, an embodiment of the light fixture 10 of the present invention is illustrated that is configured to introduce/remove air from the room area that is illuminated by the light fixture. In this embodiment, the reflector assembly 22 of the light fixture comprises a first end face 50 and an opposed second end face 52, an elongated base member 22, a linear light source 12, and a lens assembly 100. In this embodiment, a plurality of air slots 150 is defined in a portion of the base surface 30 of the base member 22. The plurality of air slots 150 is in communication with a source of an air supply source 152 or an air exhaust system 154.

As described above, it is contemplated that each end face 50, 52 can be positioned at an obtuse angle with respect to the base longitudinal axis of the reflector assembly. In a further aspect, the base member 22 has a first end edge 24, a spaced second end edge 26, and a base longitudinal axis that extends between the first and second end edges. In this embodiment, the base member 22 has a first longitudinally extending side edge 28 and an opposed second longitudinally extending side edge 29. Further, a portion of the base surface of the base member defines a pair of adjoining, parallel hollows 32. At least a portion of a section of each hollow is normal to the base longitudinal axis and extends inwardly toward a central portion 38 that is defined between the respective first and second longitudinally extending hollow edges 34, 36. In one example, at least a portion of a section of the hollow 32 normal to the base longitudinal axis has a generally curved shape. In a further aspect, the central portion 38 of the each hollow be positioned generally symmetrical with respect to the respective first and second hollow edges and can define a longitudinally extending trough 40.

In this aspect, the second hollow edge 36 of a first hollow 32' of the pair of hollows and the first hollow edge 34 of a second hollow 32" of the pair of hollows are positioned proximate each other. In one aspect, the second hollow edge 36 of the first hollow 32' of the pair of hollows and the first hollow edge 34 of the second hollow 32" of the pair of hollows form a common edge 156.

In one exemplary aspect, each air slot 150 can be defined in a portion of the first hollow 32' and a portion of the second hollow 32". For example, each slot 150 can be a contiguous slot that extends through the common edge 156 and into portions of both of the respective first and second hollows. In another example, each slot 150 can be discontinuous and can be defined in portion of the respective first and second hollows without extending across the common edge. In yet another aspect, each air slot 150 can be defined in respective portions of the first hollow, the second hollow, or portions of each of the first and second hollows, as desired. In another exemplary aspect, it is contemplated that each air slot can be positioned such that an air slot longitudinal axis extends between about 0° to about 90° to the base longitudinal axis. For example, in one exemplary embodiment, each air slot is positioned substantially transverse to the base longitudinal axis.

As described above, the linear light source 12 is mountable within the trough 40 of the base member. In a further aspect, the lens assembly 100 is configured to be positioned with respect to the light source and detachably secured to a portion of the trough of the base member such that the light source is substantially enclosed. In this aspect, the lens 110 of the lens assembly is positioned with respect to the trough such that substantially all of the light emitted by the linear light source passes through the lens. Further, it is contemplated, in one example, that the air slots are spaced from the lens assembly when the lens assembly is releasably mounted to the base member.

In one exemplary aspect, and as described above, the lens assembly 100 can comprise an elongate lens 110 having a first end edge 112, an opposed second end edge 113, and a central lens portion 114 that extends between the first and second end edges. In one aspect, the central lens portion 114 defines a concave face. In yet another aspect, the lens assembly can further comprise a diffuser inlay that is configured to be positioned between the linear light source and the concave face of the central lens portion. In one exemplary aspect, the diffuser inlay can be positioned in substantial overlying registration with portions of the concave face of the central lens portion In another aspect, the plurality of air slots 150 can define an array of air slots 160 that is positioned between the first end edge 24 and second end edge 26 of the base member. In this aspect, the array of air slots 160 can be spaced from the respective first and second end edges of the base member. In another example, the array of air slots is spaced from the respective first and second end faces. In a further aspect, it is contemplated that adjoining air slots of the plurality of air slots 150 can be spaced equally apart across the array of air slots 160 or can be spaced irregularly across the array of air slots 160.

In a further aspect, the air handling light fixture 10 can comprise a deflector 170 that is positioned proximate the second hollow edge 36 of the first hollow 32' of the pair of hollows and the first hollow edge 34 of the second hollow 32" of the pair of hollows. In this aspect, it is contemplated that the deflector 170 can extend substantially upwardly from an upper surface 171 of the base member 22. In another aspect, a bottom edge 172 of the deflector can be configured to be positioned adjacent to the upper surface of the base member proximate the common edge 156 formed by the second hollow edge of the first hollow of the pair of hollows and the first hollow edge of the second hollow of the pair of hollows. In this position, and in the exemplary example where portions of the air slots are defined in each respective first and second hollow, the deflector prevents a portion of an air slot that is defined in the first hollow from being visible to an external observer through a portion of an air slot that is defined in the second hollow. Thus, the external observer's view of the adjoining hollow through the air slots would be blocked by the deflector.

As shown in the figures, in one example, it is contemplated that the deflector 170 can be positioned to extend substantially parallel to the base longitudinal axis. Further, the deflector 170 can be positioned such that the deflector extends upwardly in a plane substantially transverse to the base longitudinal axis, i.e., the defector can be positioned in a plane that is substantially transverse to the base member. In another aspect, the deflector 170 can be positioned to bisect the light fixture along the common edge formed by the second hollow edge of the first hollow of the pair of hollows and the first hollow edge of the second hollow of the pair of hollows. For example and not meant to be limiting, the deflector can be connected to portions of the base member, or to portions of the housing, or to portions of the base member and housing as desired.

Figure 31:
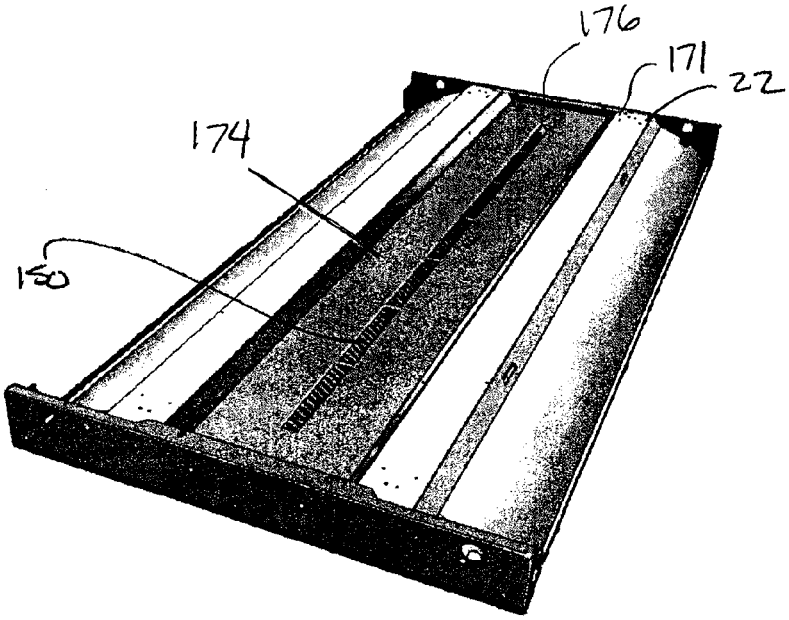
FIG. 31 is a top elevational view of one embodiment of an air handling fixture, showing a duct interface member mounted to portion of the upper surface of the base member, and showing at least one cap opening defined in the duct interface member that is in fluid communication with an interior cavity defined by a bottom surface of the duct interface member and a portion of the upper surface of the base member, which is in fluid communication with the plurality of air slots.
Figure 32:
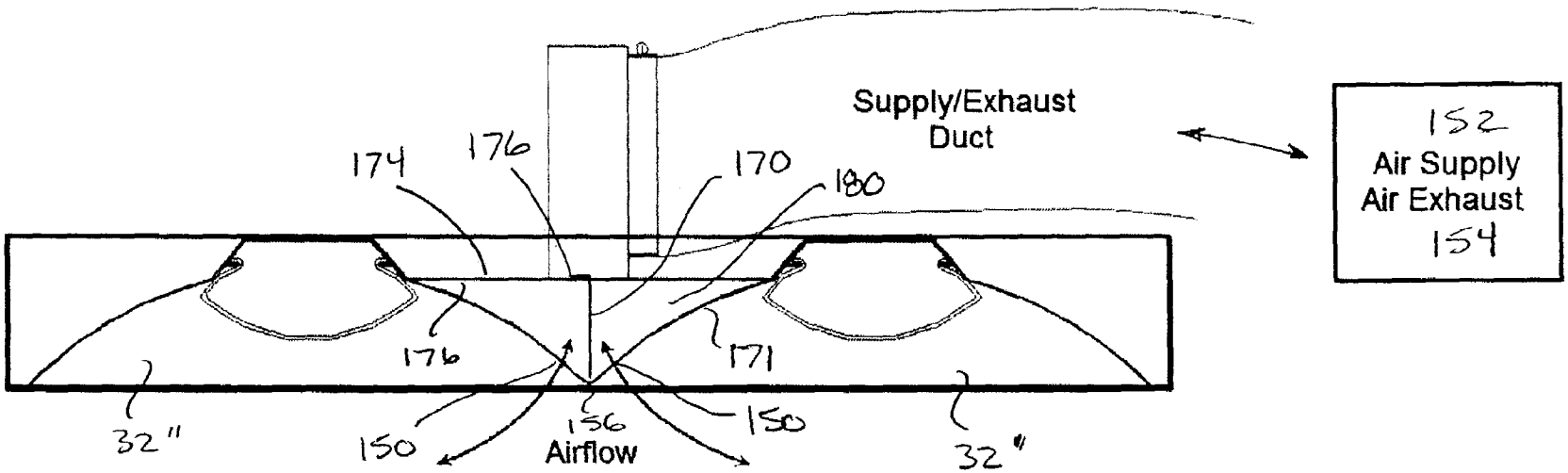
FIG. 32 is a schematic cross-sectional view of the air handling fixture of FIG. 31, showing a supply duct, in communication with an air supply source or an air exhaust system, coupled to the duct interface member such that the air supply source or air exhaust system is in fluid communication with the at least one duct opening and hence in fluid communication with the plurality of air slots.
Figure 33:
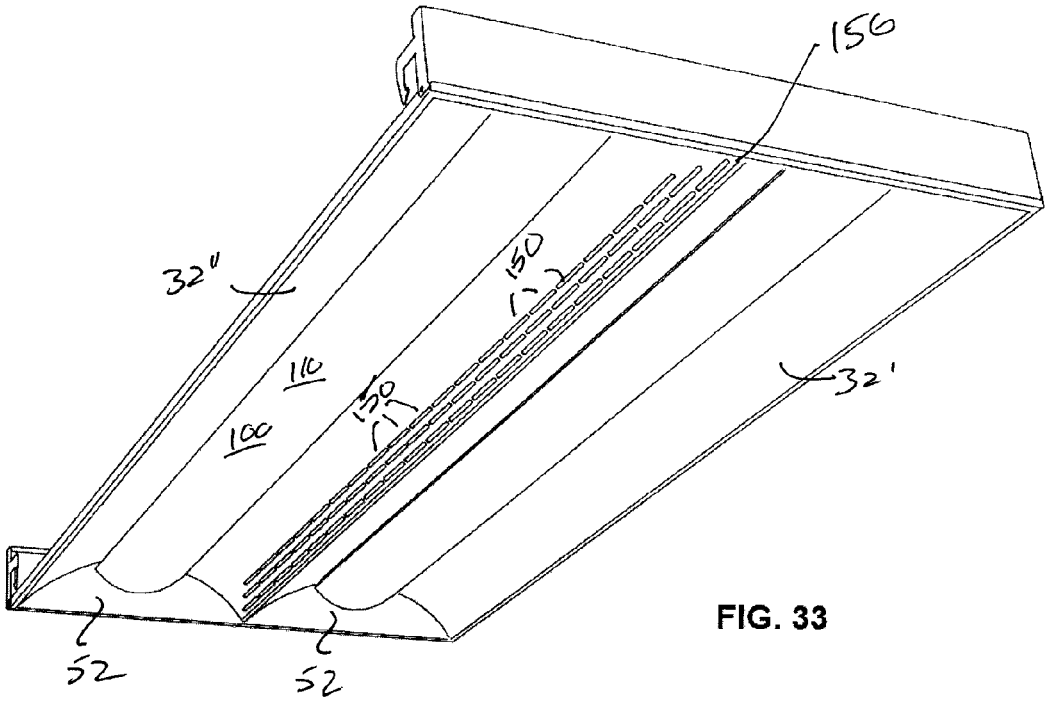
FIG. 33 is a bottom elevational view of an embodiment of an air handling light fixture, showing the plurality of air slots defined on each of the first and second hollows and spaced from the common edge between the hollows. In this example, each air slot longitudinal axis is substantially parallel to the base longitudinal axis.
Figure 34:
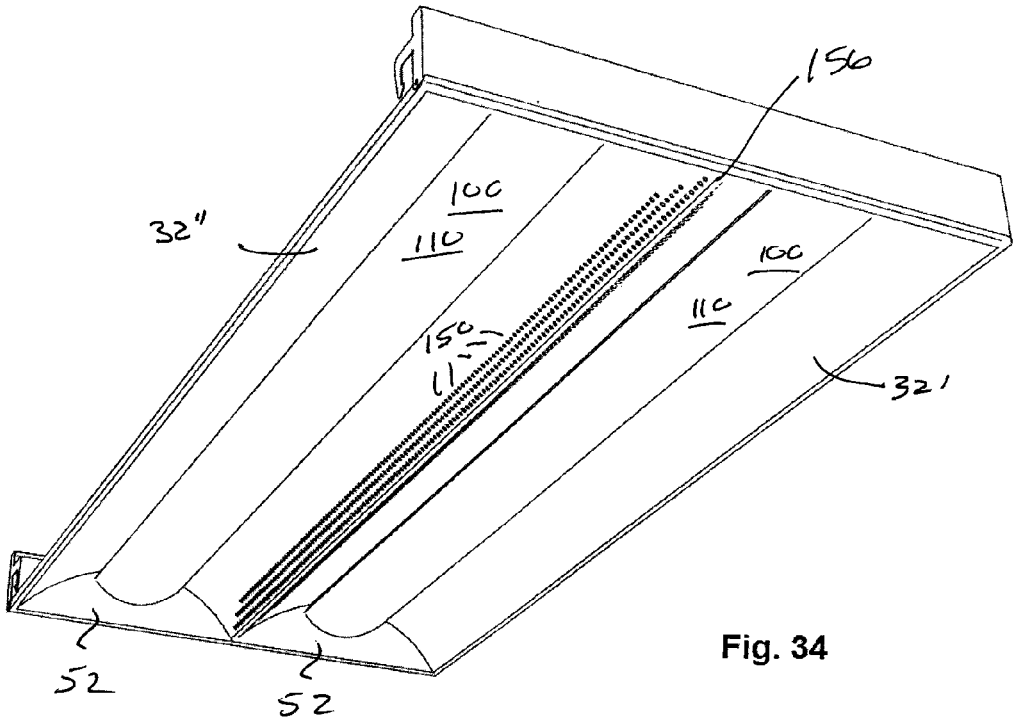
FIG. 34 is a bottom elevational view of one embodiment of an air handling light fixture, showing a plurality of air slots or perforations defined in the respective first and second hollows of the light fixture intermediate the common edge of the hollows and each respective lens assembly.

In another aspect and as shown in FIGS. 31 and 32, the air handling light fixture 10 can comprise a duct interface member 174 that is configured to be mounted to portions of the upper surface 171 of the base member 22. The duct interface member 174 further defines at least one cap opening 176. In this aspect, a bottom surface 178 of the duct interface member 174 and portions of the upper surface 171 of the base member define an interior cavity 180 that is in fluid communication with the plurality of air slots 150 and the at least one cap opening 174. It is contemplated that the at least one cap opening 174 can be positioned in fluid communication with the air supply source 152 or the air exhaust system 154.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A light fixture, comprising:

a reflector assembly extending along a base longitudinal axis, wherein the reflector assembly comprises:

a first end face and an opposed second end face, wherein each end face is positioned at an obtuse angle with respect to the base longitudinal axis of the reflector assembly; and an elongated base member having a first end edge, a spaced second end edge, and a base surface, the base longitudinal axis extending between the first and second end edges, wherein the base member has a first longitudinally extending side edge and an opposed second longitudinally extending side edge, a portion of the base surface of the base member defining a pair of adjoining, parallel hollows, each hollow having a longitudinally extending first hollow edge and a longitudinally extending second hollow edge, at least a portion of a section of each hollow being normal to the base longitudinal axis, wherein each hollow extends inwardly toward a central portion defined between the respective first and second hollow edges, wherein the central portion of the hollow defines a longitudinally extending trough; wherein the second hollow edge of a first hollow of the pair of hollows and the first hollow edge of a second hollow of the pair of hollows are positioned proximate each other, and wherein a plurality of air slots is defined in a portion of the base surface of the base member;

a linear light source mounted within the trough of the base member; and a lens assembly comprising an elongate lens having a first end edge, an opposed second end edge, and a central lens portion that extends between the first and second end edges, the central lens portion defining a concave face positioned with respect to the light source, wherein the lens is constructed and arranged being for detachably secured to a portion of the trough of the base member.

2. The light fixture of claim 1, wherein the second hollow edge of the first hollow of the pair of hollows and the first hollow edge of the second hollow of the pair of hollows form a common edge.

3. The light fixture of claim 1, wherein each air slot is defined in a portion of the first hollow and a portion of the second hollow.

4. The light fixture of claim 1, wherein each air slot is positioned substantially transverse to the base longitudinal axis.

5. The light fixture of claim 1, wherein the base member has a top surface, and further comprising a deflector positioned proximate the second hollow edge of the first hollow of the pair of hollows and the first hollow edge of the second hollow of the pair of hollows, wherein the deflector extends upwardly from the upper surface of the base member.

6. The light fixture of claim 5, wherein the second hollow edge of the first hollow of the pair of hollows and the first hollow edge of the second hollow of the pair of hollows form a common edge, and wherein a bottom edge of the deflector is positioned adjacent the common edge of the upper surface of the base member.

7. The light fixture of claim 6, wherein the deflector extends substantially parallel to the base longitudinal axis, and wherein the deflector extends upwardly in a plane substantially transverse to the base longitudinal axis.

8. The light fixture of claim 1, wherein the plurality of air slots defines an array of air slots positioned between the first end edge and second end edge of the base member.

9. The light fixture of claim 8, wherein the array of air slots is spaced from the respective first and second end edges of the base member.

10. The light fixture of claim 8, wherein the array of air slots is spaced from the respective first and second end faces.

11. The light fixture of claim 6, further comprising a duct interface member mounted to portions of the upper surface of the base member, wherein a bottom surface of the duct interface member and portions of the upper surface of the base member define an interior cavity that is in fluid communication with the plurality of air slots, and wherein the duct interface member defines at least one cap opening in fluid communication with the interior cavity.

12. The light fixture of claim 11, wherein at least one cap opening in the duct interface member is in fluid communication with an air supply source.

13. The light fixture of claim 11, wherein at least one cap opening is in the duct interface member is in fluid communication with an air exhaust system.

14. The light fixture of claim 1, wherein the linear light source has at least one end, and wherein the at least one end face of the reflector assembly defines an opening constructed and arranged for receiving at least a portion of the at least one end of the linear light source.

15. The light fixture of claim 1, wherein each of the respective first and second end faces has a top edge, the opposed first and second end faces each being positioned with respect to the base member such that a portion of the top edge of the respective end face is positioned in substantially overlying registration with a portion of the base surface.

16. The light fixture of claim 1, wherein each of the respective first and second end faces has a face longitudinal axis that forms the obtuse angle with respect to the longitudinal axis of the base member.

17. The light fixture of claim 16, wherein at least a portion of the top edge of the respective end faces is spaced from at least a portion of the respective first and second end edges of the base member.

18. The light fixture of claim 16, wherein the respective obtuse angles formed between the face longitudinal axis of the first end face and the base longitudinal axis and between the face longitudinal axis of the second end face and the base longitudinal axis are substantially equal.

19. The light fixture of claim 1, wherein each of the first and second end faces is substantially planar.

20. The light fixture of claim 1, wherein portions of each of the first and second end faces are non-planar.

21. The light fixture of claim 20, wherein portions of each of the first and second end faces are curved.

22. The light fixture of claim 1, wherein the obtuse angle is in the range of from about 95° to about 160°.

23. The light fixture of claim 1, wherein the linear light source comprises a first end operatively connected to the base member adjacent the first end face and a second end operatively connected to the base member adjacent the second end face, and wherein the first and second faces, respectively, each defines an opening therein configured to receive at least a portion of a selected end of the light source therethrough.

24. The light fixture of claim 23, further comprising a housing having a first end wall and an opposed second end wall, wherein the first end wall is connected to a portion of the first end edge of the base member and the second end wall is connected to a portion of the second end edge of the base member.

25. The light fixture of claim 24, wherein a portion of a bottom edge of the first end face is connected to a bottom portion of the first end wall of the housing and a portion of a bottom edge of the second end face is connected to a bottom portion of the second end wall, and wherein portions of the respective first and second end faces, the respective first and second end walls, and the base member each define a chamber adjacent the respective top edges of the first and second faces that is in operative communication with the opening in the respective first and second faces.

26. The light fixture of claim 25, wherein each of the respective chambers is constructed and arranged to receive at least a portion of a selected end of the linear light source therein.

27. The light fixture of claim 1, wherein the base member comprises a single piece of material.

28. The light fixture of claim 1, wherein the central portion of each hollow is generally symmetrically positioned with respect to the first and second hollow edges.

29. The light fixture of claim 28, wherein at least a portion of a section of the hollow normal to the base longitudinal axis has a generally curved shape.

30. The light fixture of claim 1, wherein the lens assembly further comprises a diffuser inlay positioned between the linear light source and the concave face of the central lens portion.

31. The light fixture of claim 30, wherein the diffuser inlay is positioned in substantial overlying registration with the concave face of the central lens portion.

32. The light fixture of claim 1, wherein the lens is positioned with respect to the trough such that substantially all of the light emitted by the linear light source passes through the lens.

33. The light fixture of claim 1, wherein the linear light source comprises a T5 lamp.

34. The light fixture of claim 1, wherein at least a portion of the reflector assembly is coated with a substantially flat reflective material.

35. A light fixture, comprising:

a reflector assembly extending along a longitudinal axis, the reflector assembly comprising an elongated base member having a first end edge, a spaced second end edge, a first longitudinally extending side edge, an opposed second longitudinally extending side edge, and a base surface, the longitudinal axis of the reflector assembly extending between the first end edge and the second end edge, wherein a portion of the base surface of the base member defines a first hollow and an adjoining parallel second hollow, each hollow having a longitudinally extending first hollow edge and a longitudinally extending second hollow edge, wherein the second hollow edge of the first hollow and the first hollow edge of the second hollow for a common edge, wherein each hollow extends inwardly toward a central portion defined between the respective first and second hollow edges, wherein the central portion of each hollow defines a longitudinally extending trough that extends inwardly of each hollow, wherein the trough has a top surface that adjoins each of a first side trough surface and an opposed second side trough surface, wherein each respective first and second side trough surface has a lower edge that is integral with a portion of the adjoined hollow, and wherein each of the first side trough surface and the second side trough surface has a trough surface axis that extends in a plane normal to the base longitudinal axis, and wherein a plurality of air slots is defined in a portion of the base surface of the base member;

a linear light source operatively mounted within a portion of the trough of the reflector assembly; and a lens assembly comprising an elongated lens mounted to a portion of the reflector assembly, wherein the reflector assembly controls high angle glare in a transverse direction by blocking high angle rays from the lens, and wherein the lens controls high angle glare in the longitudinal direction optically.

36. The light fixture of claim 35, wherein each air slot is defined in a portion of the first hollow and a portion of the second hollow.

37. The light fixture of claim 35, wherein each air slot is positioned substantially transverse to the base longitudinal axis.

38. The light fixture of claim 35, wherein the base member has an upper surface, and further comprising a deflector positioned proximate the second hollow edge of the first hollow of the pair of hollows and the first hollow edge of the second hollow of the pair of hollows, wherein the deflector extends upwardly from the upper surface of the base member.

39. The light fixture of claim 38, wherein a bottom edge of the deflector is positioned adjacent the common edge of the top surface of the base member.

40. The light fixture of claim 39, wherein the deflector extends substantially parallel to the base longitudinal axis, and wherein the deflector extends upwardly in a plane substantially transverse to the base longitudinal axis.

41. The light fixture of claim 35, wherein the plurality of air slots defines an array of air slots positioned between the first end edge and second end edge of the base member.

42. The light fixture of claim 41, wherein the array of air slots is spaced from the respective first and second end edges of the base member.

43. The light fixture of claim 41, wherein the array of air slots is spaced from the respective first and second end faces.

44. The light fixture of claim 38, further comprising a duct interface member mounted to portions of the upper surface of the base member, wherein a bottom surface of the duct interface member and portions of the upper surface of the base member define an interior cavity that is in fluid communication with the plurality of air slots, and wherein the duct interface member defines at least one cap opening in fluid communication with the interior cavity.

45. The light fixture of claim 44, wherein the opening in the duct interface member is in fluid communication with an air supply source.

46. The light fixture of claim 44, wherein the opening is in the duct interface member is in fluid communication with an air exhaust system.

47. The light fixture of claim 35, wherein at least a portion of a section of each respective first and second hollow normal to the base longitudinal axis has a generally curved, concave shape.

48. The light fixture of claim 47, wherein portions of each respective first and second hollow extending between the central portion and the respective first and second hollow edges forms a curved reflective surface.

49. A light fixture, comprising:

a reflector assembly extending along a longitudinal axis and defining a trough, the reflector assembly comprising:

an elongated base member having a first end edge, a spaced second end edge, a first longitudinally extending side edge, an opposed second longitudinally extending side edge, and a base surface, the longitudinal axis of the reflector assembly extending between the first end edge and the second end edge of the base member, wherein a plurality of air slots is defined in a portion of the base surface of the base member; and a first end face and an opposed second end face, each of the respective first and second end faces having a top edge, the opposed first and second end faces each being positioned with respect to the base member such that a portion of the top edge of each respective end face is positioned in substantially overlying registration with a portion of the base surface, and wherein each of the respective first and second end faces has a face longitudinal axis that forms an obtuse angle with respect to the base longitudinal axis of the base member;

a linear light source operatively mounted within a portion of the trough of the reflector assembly; and a lens assembly comprising an elongated lens mounted to a portion of the reflector assembly, wherein the reflector assembly controls high angle glare in a transverse direction by blocking high angle rays from the lens, and wherein the lens controls high angle glare in the longitudinal direction optically.

50. The light fixture of claim 49, wherein the plurality of air slots is in fluid communication with an air supply source.

51. The light fixture of claim 49, wherein the plurality of air slots is in fluid communication with an air exhaust system.

* * * * *